US009670033B1

(12) United States Patent
Lieberman et al.

(10) Patent No.: US 9,670,033 B1
(45) Date of Patent: Jun. 6, 2017

(54) DEPLOYABLE CANOPY APPARATUS

(71) Applicant: Francesco Lieberman, Sarasota, FL (US)

(72) Inventors: Francesco Lieberman, Sarasota, FL (US); Jan S. Gross, Sarasota, FL (US)

(73) Assignee: Francesco Lieberman, Sarasota, FL (US)

( * ) Notice: Subject to any disclaimer, the term of this patent is extended or adjusted under 35 U.S.C. 154(b) by 0 days.

(21) Appl. No.: 15/268,393

(22) Filed: Sep. 16, 2016

(51) Int. Cl.
*E04F 10/02* (2006.01)
*B65H 75/44* (2006.01)
*E06B 9/58* (2006.01)

(52) U.S. Cl.
CPC ..... *B65H 75/4402* (2013.01); *E04F 10/02* (2013.01); *E06B 9/58* (2013.01); *E06B 9/581* (2013.01); *B65H 2403/30* (2013.01)

(58) Field of Classification Search
CPC ..... E04F 10/02; E04F 10/06; E04F 10/067; E04F 10/0607; E04F 10/0637; E06B 2009/583; E06B 9/58; E06B 9/581
USPC ..... 160/277, 121.1, 122, 273.1
See application file for complete search history.

(56) References Cited

U.S. PATENT DOCUMENTS 3,952,758 A * 4/1976 Addison ..... B60P 3/343 135/141
4,673,019 A * 6/1987 Silverthorne ..... E06B 9/54 160/268.1
4,724,882 A * 2/1988 Wang ..... E04F 10/0614 135/117
5,685,354 A * 11/1997 Kim ..... B60J 1/2033 160/122
5,762,403 A 6/1998 Robinson
5,911,478 A 6/1999 Goodman
6,068,008 A * 5/2000 Caldwell ..... A45B 23/00 135/143
6,293,624 B1 9/2001 Gaylord et al.
6,779,849 B1 8/2004 Harper et al.
6,949,027 B1 9/2005 Habing et al.
D548,472 S 8/2007 Habing et al.
7,413,000 B2 * 8/2008 Lin ..... B60J 1/2025 160/265
8,887,789 B2 11/2014 Tremaine, III et al.
2013/0105096 A1 * 5/2013 Hsieh ..... A45B 23/00 160/379

* cited by examiner

*Primary Examiner* — Blair M Johnson
(74) *Attorney, Agent, or Firm* — Jeffrey B. Fabian; Shumaker, Loop & Kendrick, LLP

(57) ABSTRACT

A deployable canopy apparatus includes canopy rails having a first, free end and a second end proximal to a spool rod. The canopy rails include a channel and a slit extending along the length of the canopy rail. A canopy is secured to the spool rod and secured to a translating member that extends between the canopy rails. The canopy has a first and a second side defining a loop housed in the canopy rails through the slits. Retaining members extend through the canopy loops and are secured within the canopy rail channels. A translation drive assembly is configured to translate the first translating member between the first and second ends of the canopy rails and spool or unspool the canopy from the spool rod.

21 Claims, 29 Drawing Sheets

DEPLOYABLE CANOPY APPARATUS

TECHNICAL FIELD AND BACKGROUND

The present invention relates generally to an apparatus for deployment of flexible, sheet materials, and more particularly, an apparatus for retraction and deployment of a screen, canopy, or the like.

Conventional methods for retracting or deploying screens, fabrics, canopies, or other materials may spool the material about a rod or axil. In some applications, it is advantageous to hold the material in place when deployed or add rigidity to the material by, for instance, applying tension to the material through the use of rigid support members. However, this can make spooling the material difficult or impossible. Accordingly, it is an object of the present invention to provide an apparatus capable of holding a canopy or other material in place when deployed while permitting convenient retraction and spooling of the canopy.

SUMMARY

According to one embodiment of the invention, a deployable canopy apparatus includes: a first support and a second support having a first axis extending between a forward direction and a rearward direction and a second axis transverse to the first axis; a spool rod affixed to the first support and affixed to the second support; an actuator in mechanical communication with the spool rod and configured to rotate the spool rod; a first, second, third, and fourth canopy rail each having a free end and a fixed end attached to the supports, where the canopy rails have a channel and a slit extending at least partially along a length of the canopy rail from the fixed end to the free end; a first and second translating member extending between the canopy rails; a canopy secured to the spool rod having a first end secured to the first translating member, a second end secured to the second translating member, a first side defining a loop housed within the first and third canopy rails through the slits, and a second side defining a loop housed within the second and fourth canopy rails through the slits; retaining members extending through the canopy loops and secured within the canopy rail channels; and a translation drive assembly configured to translate the first translating member between the free ends and the fixed ends of the canopy rails.

In one embodiment of the invention, the translation drive assembly includes: four sliders in the respective canopy rails, where the sliders include a groove to accommodate the rail slits and where the sliders are coupled to the translating members; four spindles disposed about spindle posts that are secured to the canopy rails; first and second cable spools in mechanical communication with the spool rod such that the cable spools rotate with the spool rod; and cables affixed to the sliders and extending around the spindles through a passage in the cable spools.

In one aspect of the invention, retaining members extend through bores in the sliders, and the retaining members are formed as spring rods. In a further aspect of the invention, the canopy comprises a forward canopy section with a spool end secured to the spool rod and a rearward canopy section with a spool end secured to the spool rod. In yet another aspect of the invention, the canopy rails are attached to the supports using a hinge, including a square hinge.

For one embodiment of the invention, the actuator is made of a handle attached to the spool rod. For another embodiment of the invention, the actuator instead includes: a first sprocket disposed about the spool rod; a second sprocket disposed about a crank axil; a chain placing the first sprocket in mechanical communication with the second sprocket; and a handle in mechanical communication with the crank axil and configured to rotate the crank axil.

In another embodiment of the invention, the opposing canopy rails include a continuous segment, and the canopy can include a zipper. The invention can also include at least one transverse support member extending between the supports and feet attached to the supports. The invention may further include a swing pivot assembly affixed to the supports where the swing pivot assembly has a pin, an elbow housing, and at least one bearing, where the bearing and elbow housing are assembled about the pin. The elbow housing can include a recess to receive the bearing.

According to another embodiment of the invention, a deployable canopy apparatus includes: a first and second canopy rail having a free end and a spool end and a first axis extending along a direction from the free end to the spool end, where the canopy rails include a channel and a slit extending at least partially along a length of the canopy rails from the spool ends to the free ends. A spool rod is affixed to the first and second canopy rails along a second axis transverse to the first canopy rail first axis and the second canopy rail first axis. An actuator is in mechanical communication with the spool rod and is configured to rotate the spool rod. A translating member extends at least partially along a distance between the first canopy rail and the second canopy rail. The embodiment further includes a canopy having a spool end secured to the spool rod, a translating end secured to the translating member, a first side defining a loop housed within the first canopy rail channel, and a second side defining a loop housed within the second canopy rail channel. Retaining members extend through the canopy loops and are secured within the canopy rail channels. A translation drive assembly is configured to translate the translating member between the free ends and the fixed ends of the canopy rails.

BRIEF DESCRIPTION OF THE DRAWINGS

Features, aspects, and advantages of the present invention are better understood when the following detailed description of the invention is read with reference to the accompanying figures, in which.

DETAILED DESCRIPTION

Figure 1:
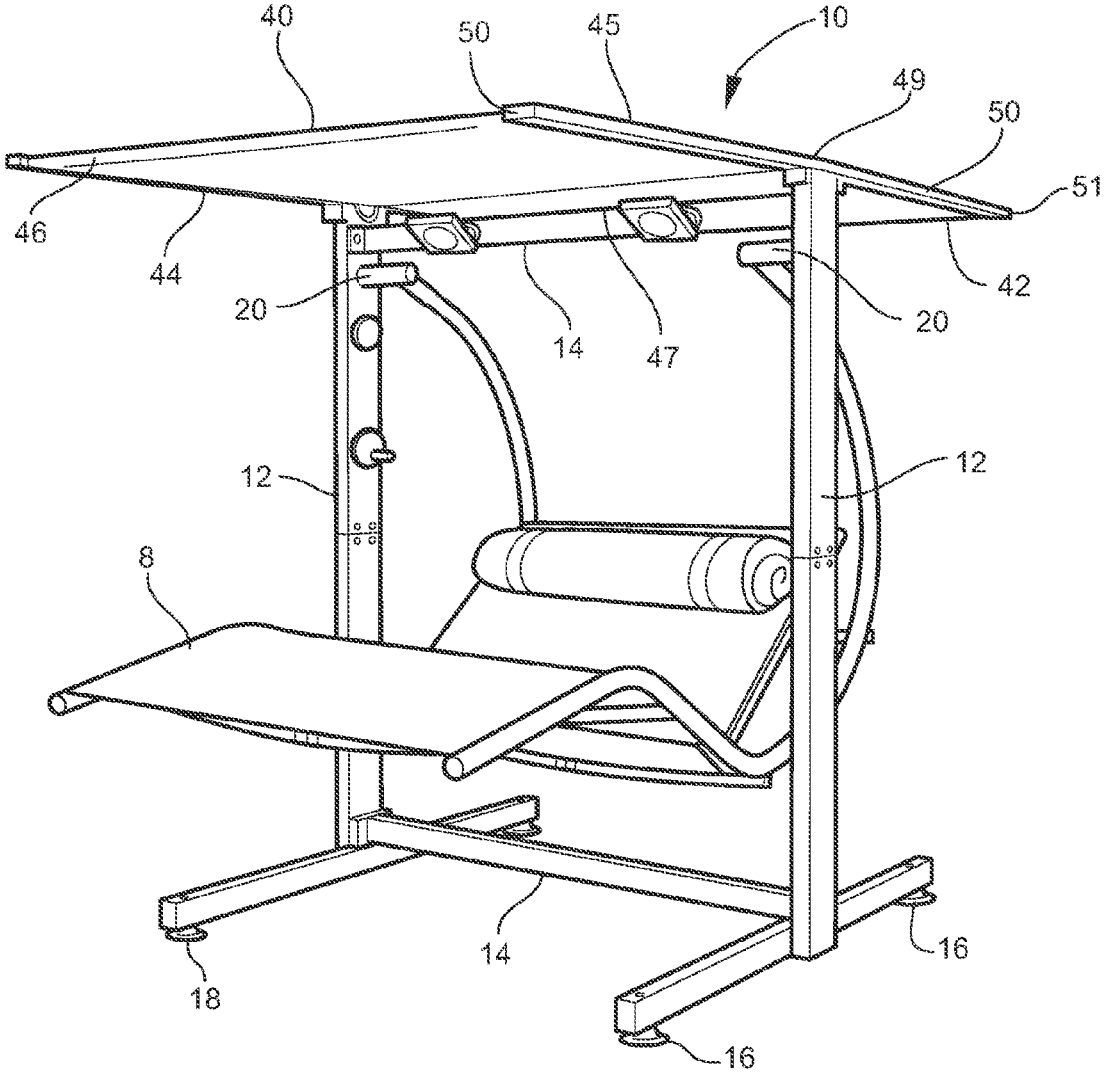
FIG. 1 is diagonal view of a deployable canopy apparatus according to one embodiment of the invention.

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete and will fully convey the scope of the invention and enable one of ordinary skill in the art to make, use, and practice the invention.

Relative terms such as lower or bottom; upper or top; upward, outward, or downward; forward or backward; and vertical or horizontal may be used herein to describe one element's relationship to another element illustrated in the figures. It will be understood that relative terms are intended to encompass different orientations in addition to the orientation depicted in the drawings. By way of example, if a component in the drawings is turned over, elements described as being on the "bottom" of the other elements would then be oriented on "top" of the other elements. Relative terminology, such as "substantially" or "about," describe the specified materials, steps, parameters, or ranges as well as those that do not materially affect the basic and novel characteristics of the claimed inventions as whole (as would be appreciated by one of ordinary skill in the art).

Disclosed is a deployable canopy apparatus. Although the inventive canopy apparatus is generally described with reference to embodiments utilized in outdoor furniture, those skilled in the art will recognize that the apparatus can be used in a variety of circumstances where it is desired to perform deployment or retraction of flexible fabric or sheet materials.

Figure 2:
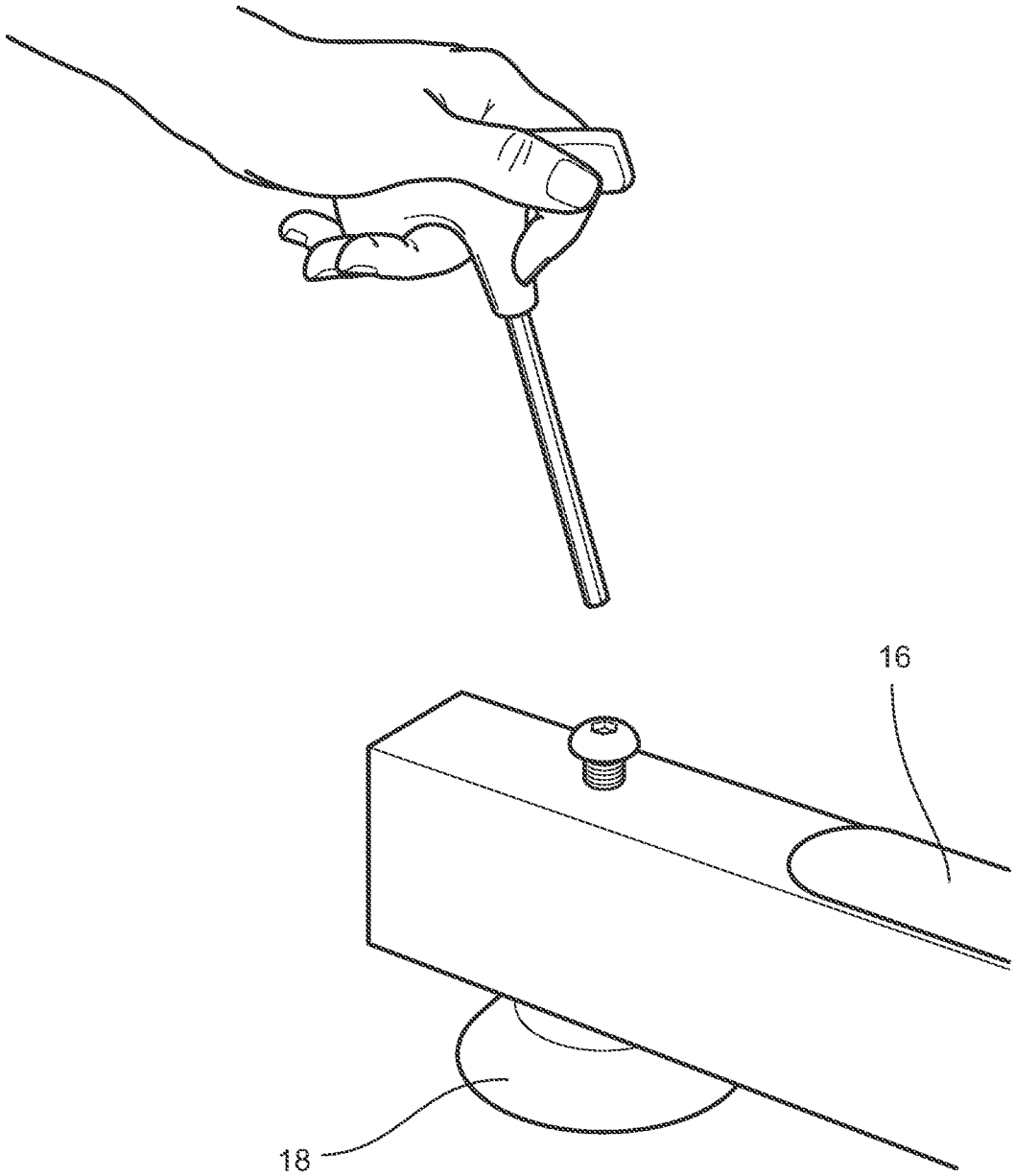
FIG. 2 is an exemplary adjustable leveling mount attached to a canopy foot.

Referring to FIG. 1, a canopy apparatus 10 is suspended above a chair 8 by two vertically aligned support members 12, or stanchions. An upper and a lower transverse support member 14 connect the stanchions 12 and provide torsional and lateral stability. Forward and rearward-facing feet 16 are affixed to the stanchions 12 to provide stability in the forward and rearward directions. An adjustable leveling mount 18 shown in FIG. 2 is attached to each of the four feet 16 so as to permit the height of each foot to be adjusted independent of the other feet by, for instance, turning a threaded fastener.

Figure 3:
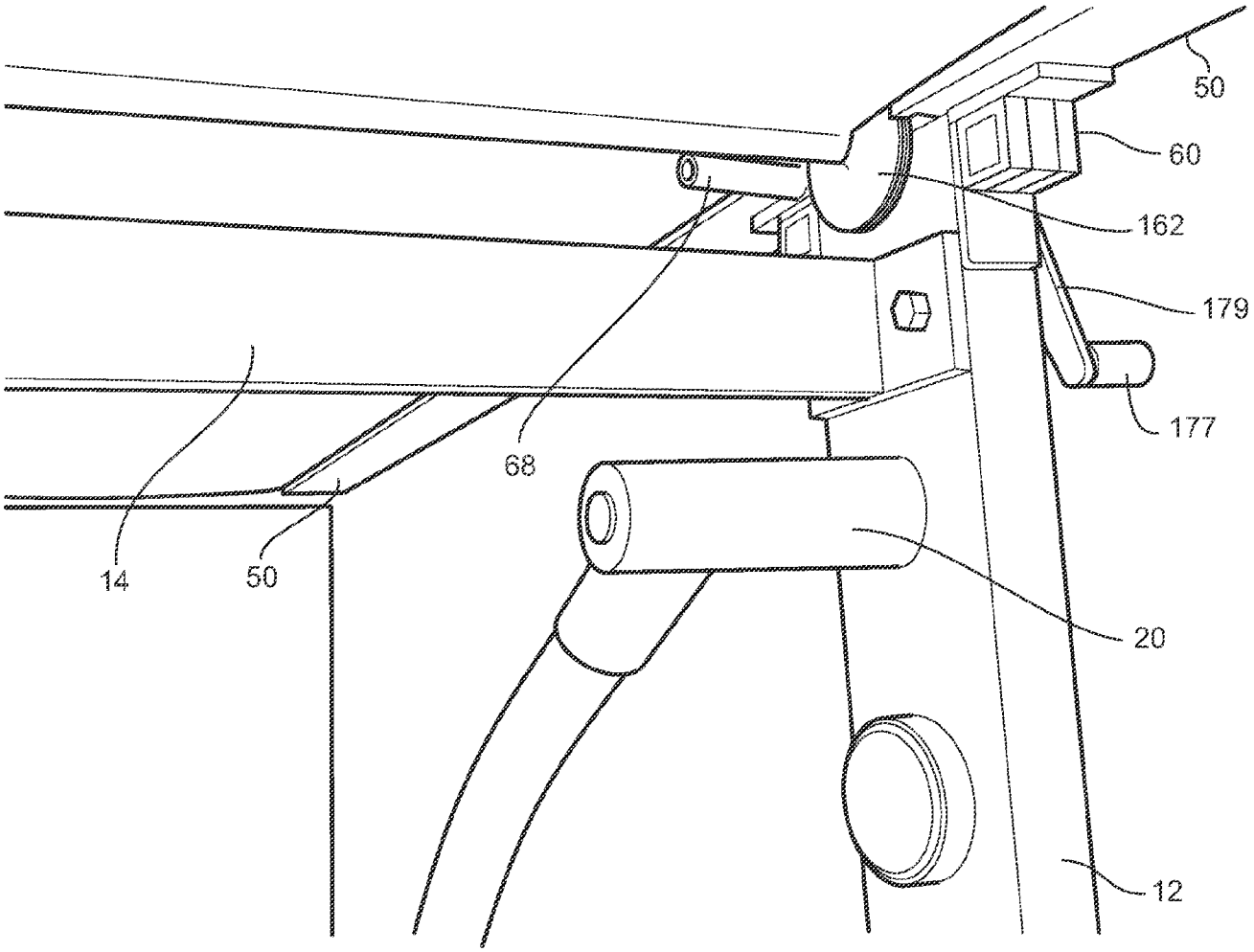
FIG. 3 is a swing pivot assembly attached to a canopy support.
Figure 4:
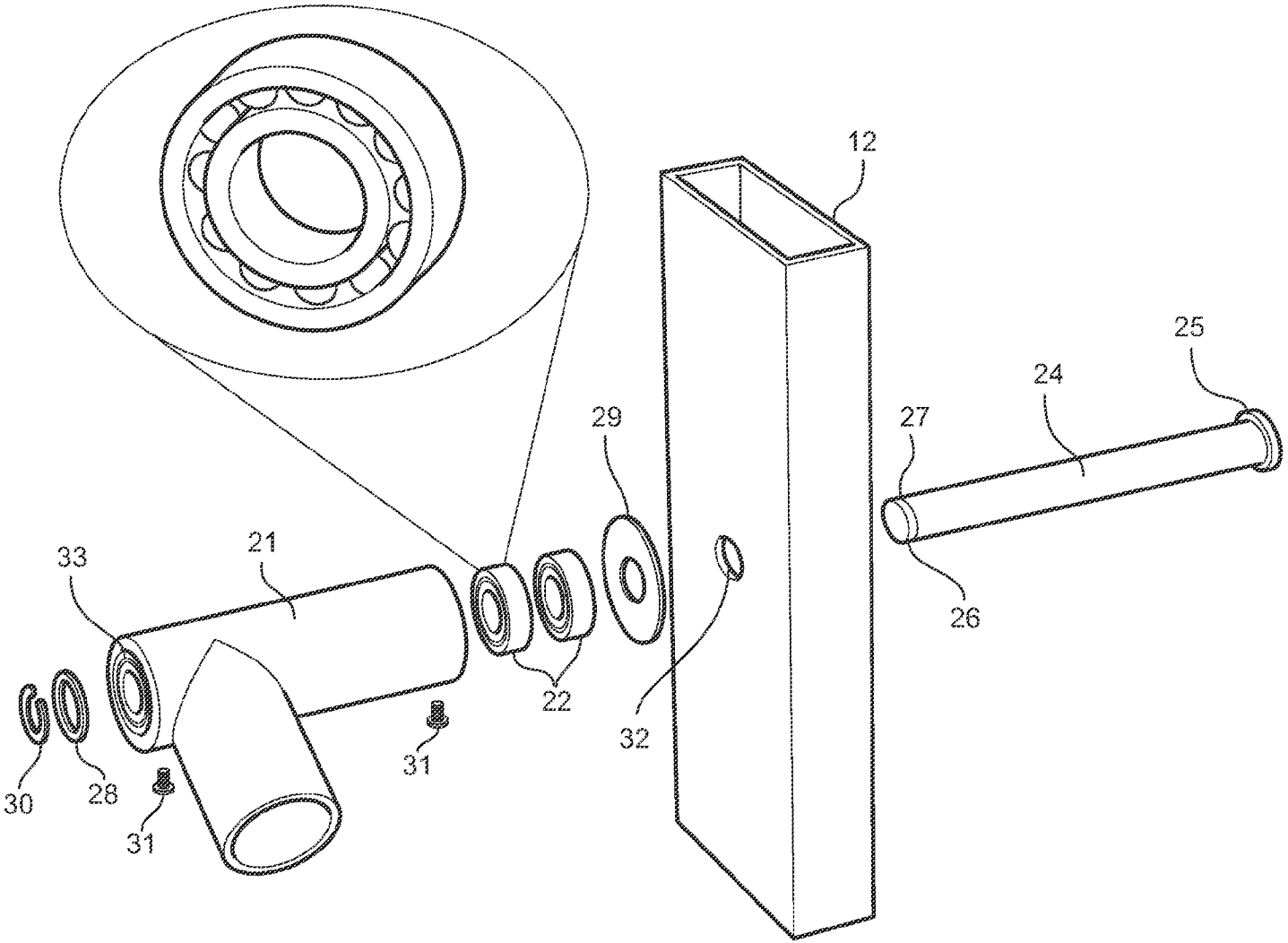
FIG. 4 is an exploded view of a swing pivot assembly according to one embodiment of the invention.
Figure 5:
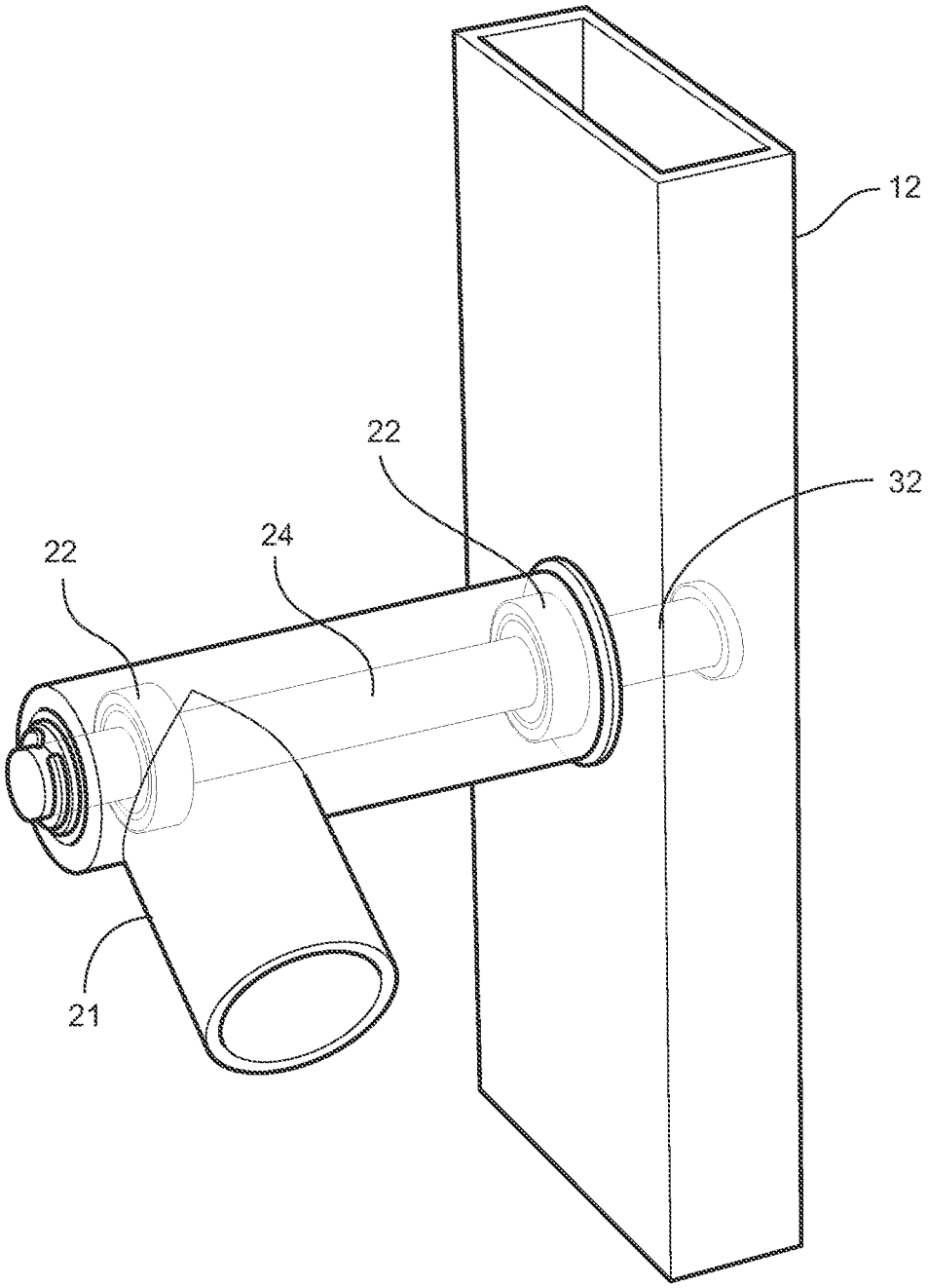
FIG. 5 is an assembled, hidden feature view of a swing pivot assembly according to one embodiment of the invention.

The chair 8 shown in FIG. 1 is pivotably connected to the stanchions 12 with the exemplary swing pivot assembly 20 shown in FIGS. 3 through 5 such that the chair 8 is configured to swing forward and rearward with minimal lateral movement. An exploded view of the swing pivot assembly is shown in FIG. 4 and includes an elbow housing 21, one or more bearings 22, a pivot pin 24, one or more washers 28 or spacers 29, a c-clip 30, and one or more set screws 31. The pivot pin 24 includes a flanged end 25 and a retaining end 26 that defines an annular groove 27 for retaining the c-clip 30. Any suitable type of bearing can be used, including, but not limited to, ball bearings, roller bearings, ceramic bearings, grooved bearings, or double-row bearings.

The pivot pin 24 resides within a pivot bore 32 in the stanchion 12 such that the flanged end 25 abuts an outer-facing surface of the stanchion 12. The spacer 29, a bearing 22, and the elbow housing 21 are assembled around the pivot pin 24 over the retaining end 26 such that the spacer 29 and bearing 22 are enclosed within the elbow housing 21. A second bearing 22 is optionally assembled around the pivot pin retaining end 26 and seated within a recess 33 in the elbow housing 21. The washer 28 and c-clip 30 are also assembled around the pivot pin retaining end 26, and the c-clip 30 is seated within the pivot pin annular groove 27. Set screws 31 secure the bearings 22 within the elbow housing 21.

Figure 6:
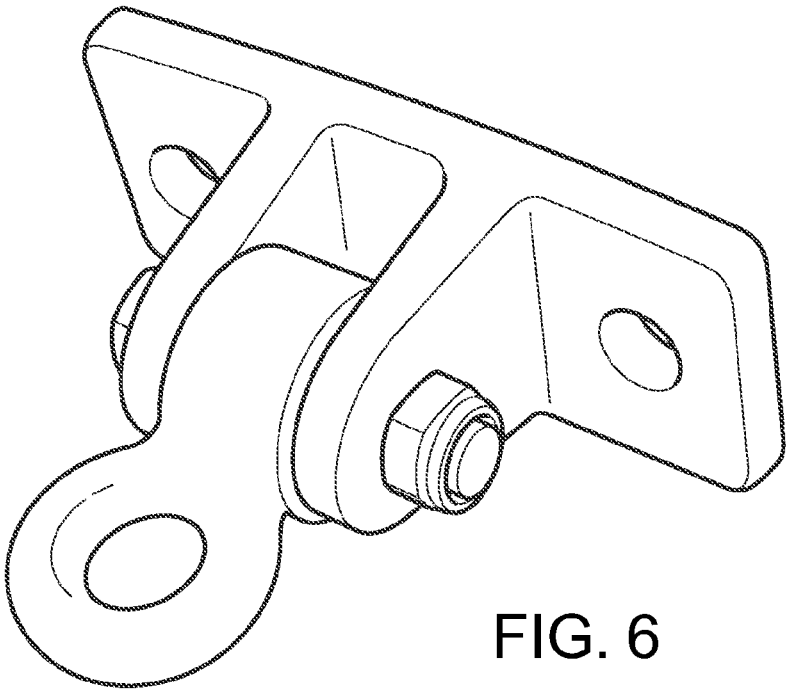
FIG. 6 is an exemplary swing hanger.
Figure 7:
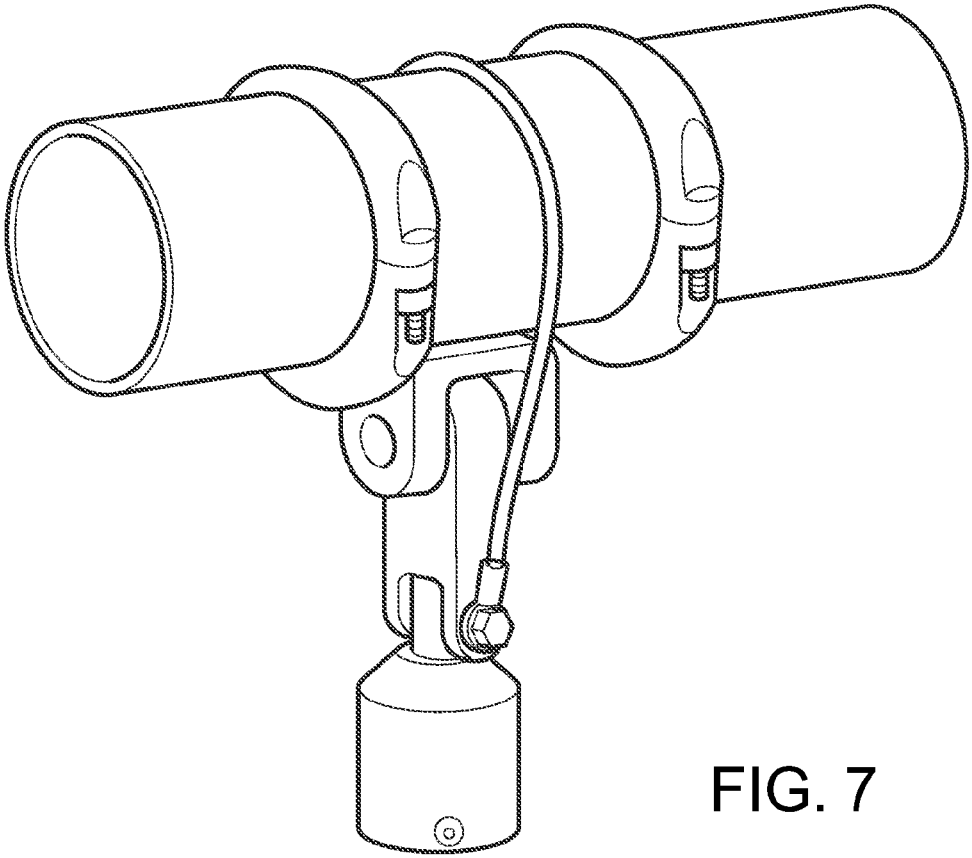
FIG. 7 is an exemplary swing swivel.

Skilled artisans will recognize that FIGS. 3 through 5 are not intended to be limiting, and any suitable type of pivot can be utilized to suspend the chair 8 from the stanchion 12, including, but not limited to, a spring pivot hinge or rack-and-pinion pivot hinge. In yet other embodiments, the chair 8 is suspended from an upper transverse support member 14 by one or more swing hangers, such as the swing hanger shown in FIG. 6. If lateral movement or rotation of the chair 8 is desired, the chair 8 can alternatively be suspended from an upper transverse support member 14 with a swing swivel, such as the exemplary swing swivel shown in FIG. 7.

Figure 8:
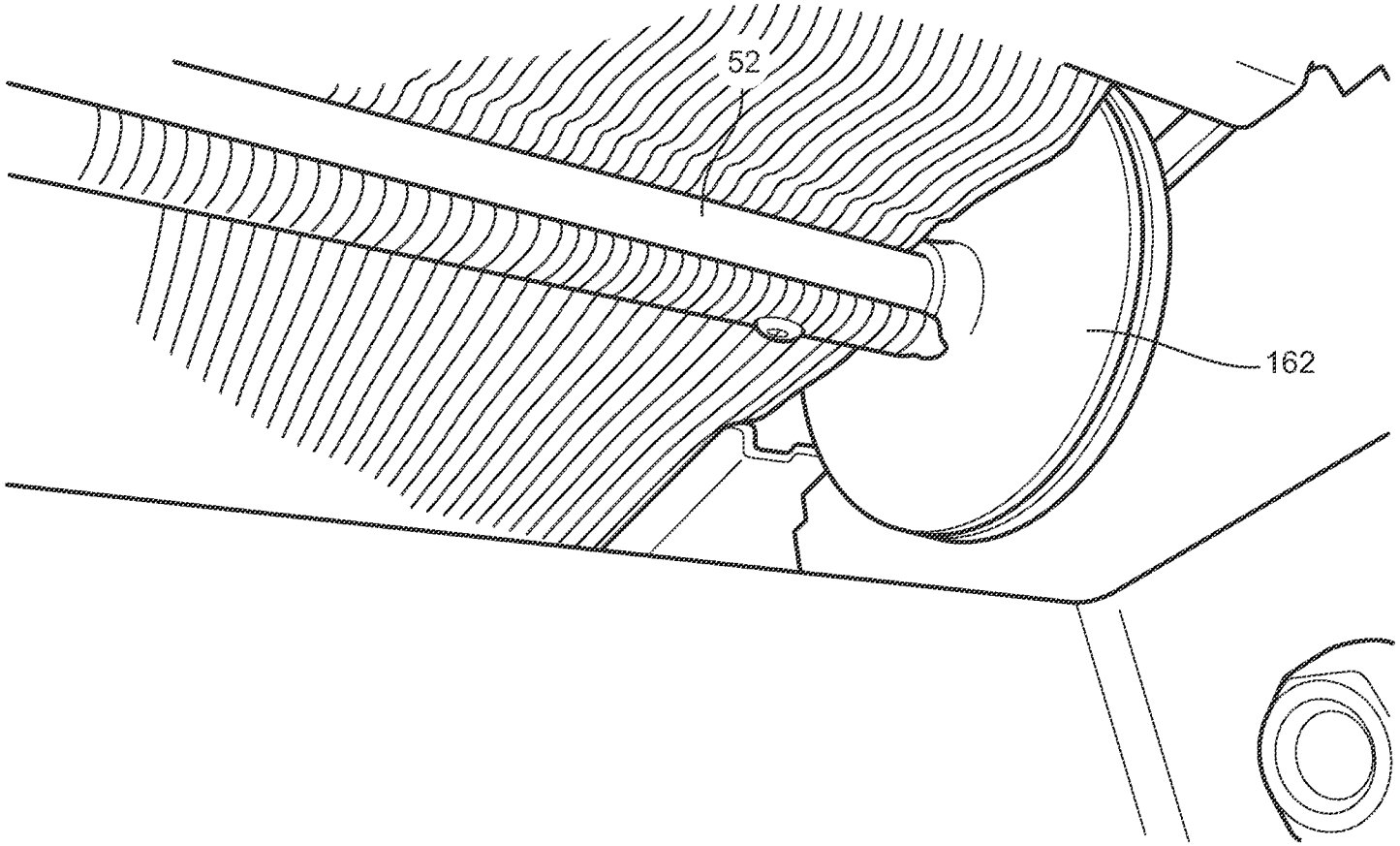
FIG. 8 illustrates attachment of a canopy to a spool rod.
Figure 9C:
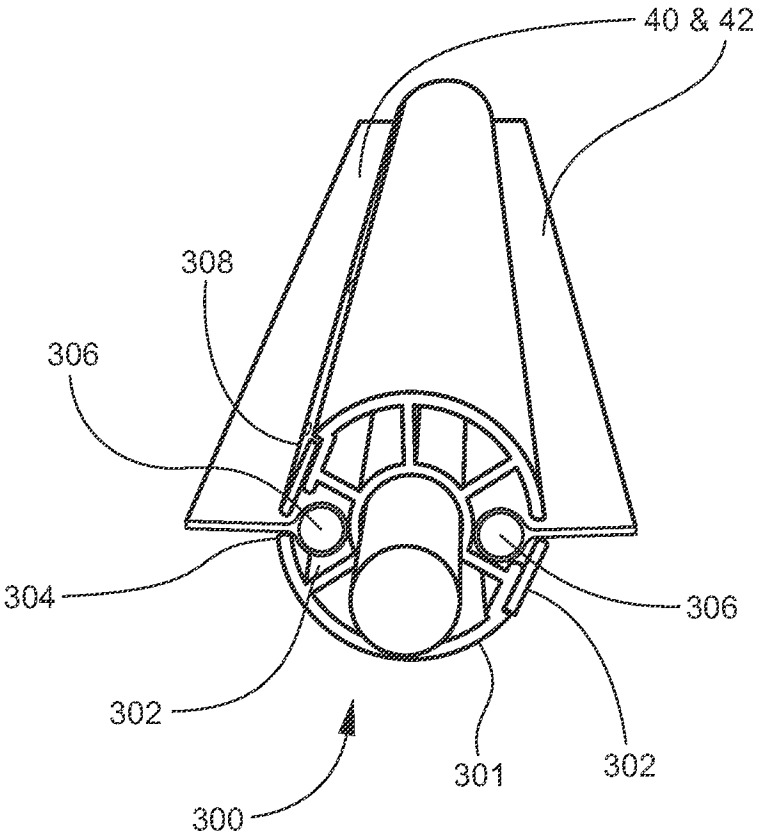
FIG. 9C illustrates an assembled extrusion with a canopy.
Figure 9B:
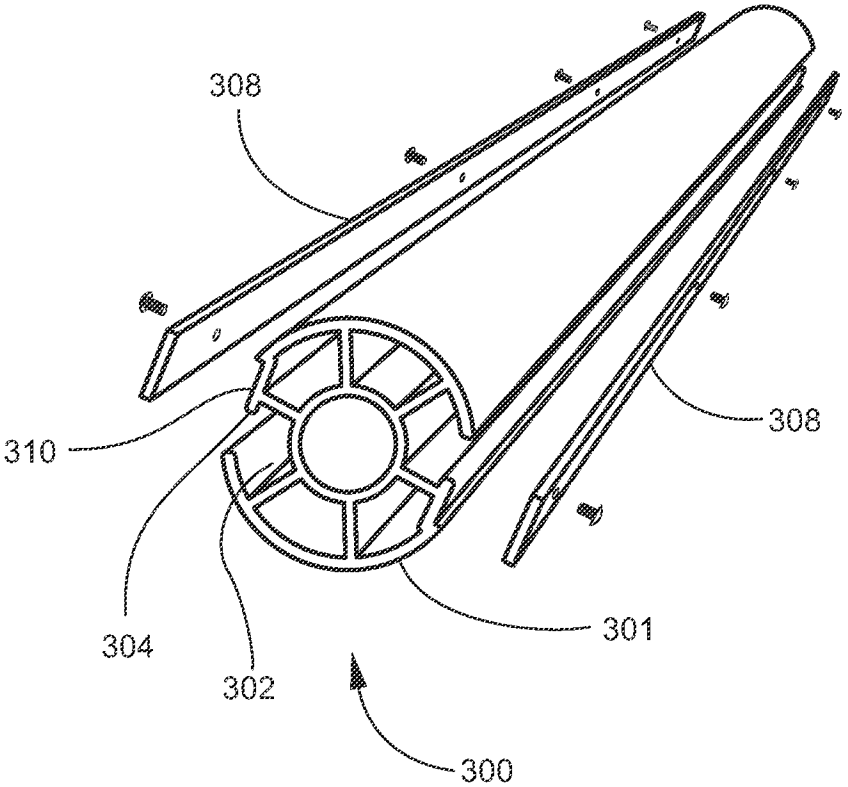
FIG. 9A illustrates a zipper disposed on a canopy.
FIG. 9 B. illustrates an exploded view of an extrusion.
Figure 9A:
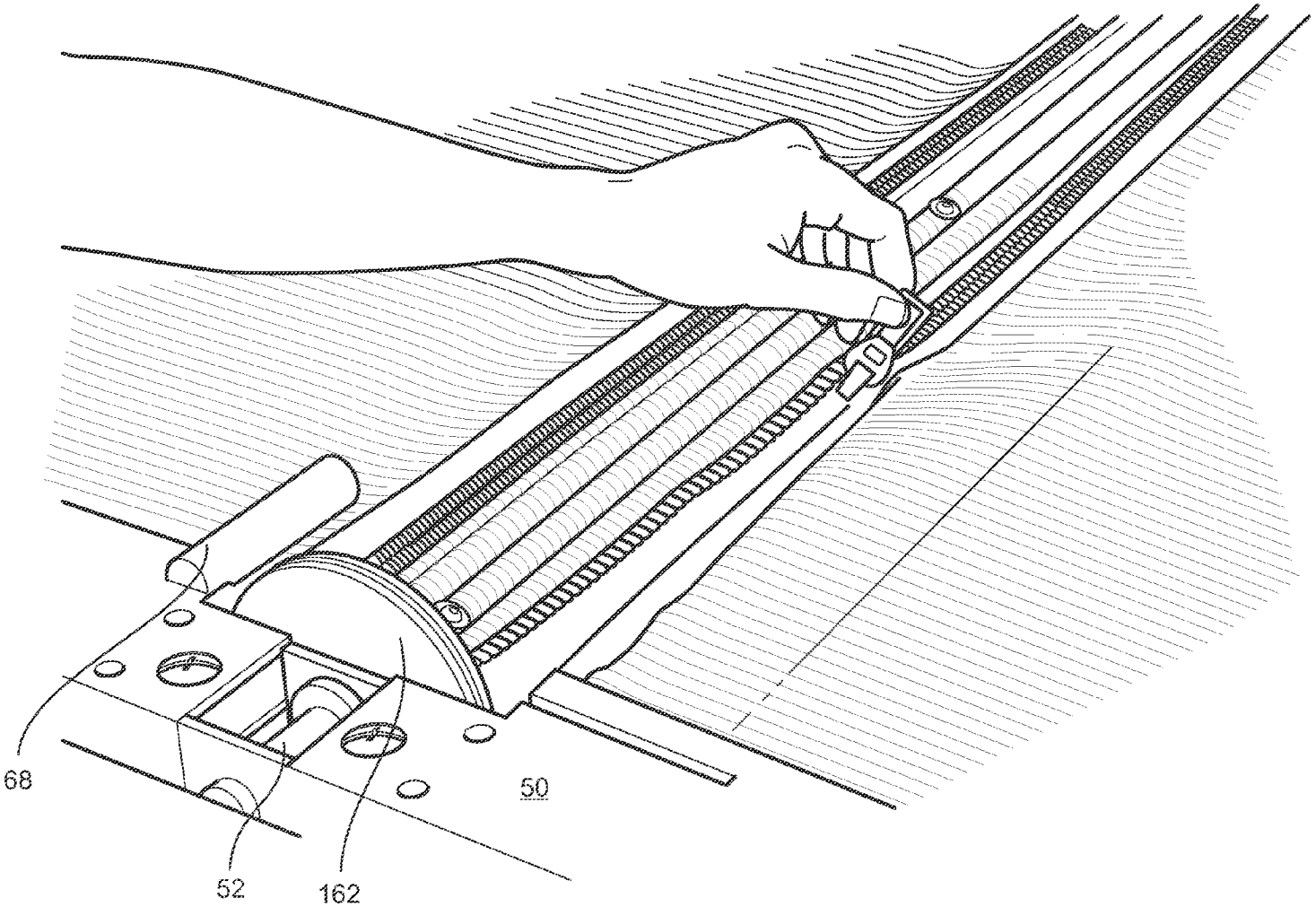

The canopy apparatus includes a forward canopy 40 and a rearward canopy 42. The canopies have a first side 44, a second side 45, a translating end 46, and a spool end 47. The canopy first side 44 and second side 45 are retained by canopy rails 50 attached to the stanchions 12. The canopy spool ends 47 are secured to a canopy spool rod 52, as shown in FIGS. 8 & 9, and the canopy translating ends 46 are secured to translating members 54, as depicted in FIGS. 10A and 10B.

At the canopy spool ends 47, the canopies can be overlapped and secured together with two lines of stitching or an adhesive along an axis extending from the first sides 44 to the second sides 45, thereby forming a loop 48 of fabric to accommodate the spool rod 52. The canopies are then secured to the spool rod 52 with bolts, screws, rivets, anchors, buttons, an adhesive, or any suitable affixing means. The canopy embodiment shown in FIG. 9A optionally includes a zipper for releaseably securing the canopy 40 & 42 to the spool rod 52 or translating member 54. The canopy 40 & 42 can also be releaseably secured to the spool rod 52 using, for instance, snap fasteners or an extrusion assembly 300, such as the extrusion assembly 300 shown in FIGS. 9B and 9C. The extrusion body 301 includes channels 302 and channel openings 304 that run along the length of the extrusion body 301. The canopy 40 & 42 ends are formed with a loop secured about a cord 306 or rod. The canopy looped ends are inserted into the channels 302 through the openings 304 and secured with the extrusion plate 308 that is affixed to a rabbet 310 with threaded fasteners, an adhesive, or any suitable affixing means.

Figure 10A:
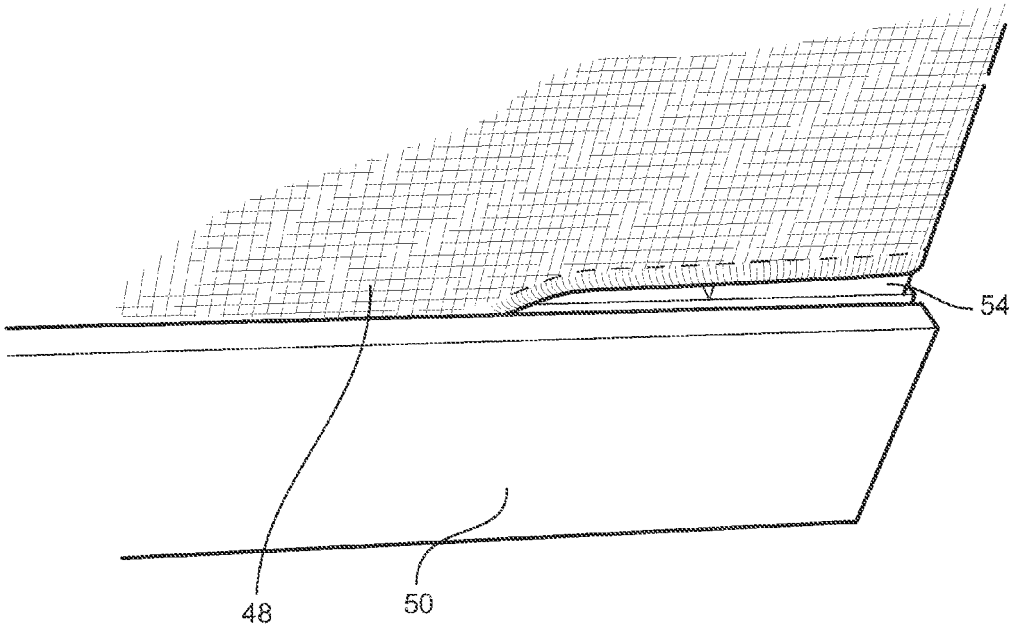
FIGS. 10A and 10B illustrate a canopy secured to a translating member.
Figure 10B:
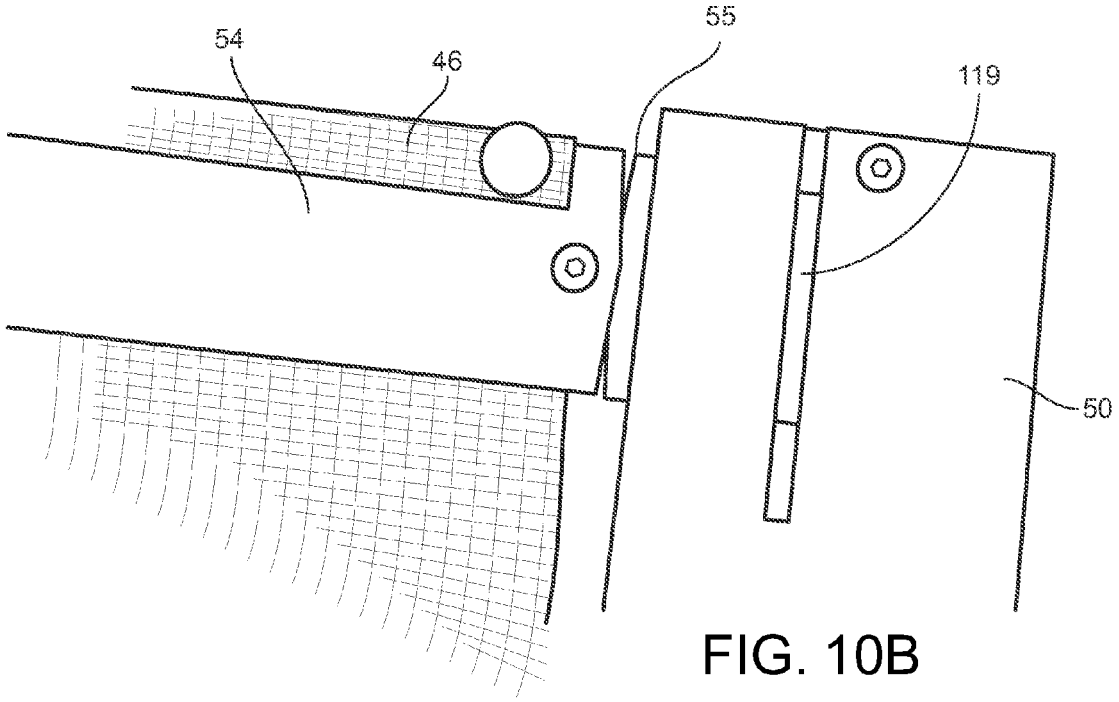

Attachment of the canopy translating end 46 to the translating member 54 is illustrated in FIGS. 10A and 10B where the canopy translating end 46 is wrapped around the lower surface of the translating member 54 and detachably affixed to the top surface of the translating member 54 with a snap button or any other suitable fastening or affixing means. Those of skill in the art will appreciate that use of a zipper or extrusion assembly 300 are just a few nonlimiting examples for releaseably securing the canopy 40 & 42 to the spool rod 52 or translating member 54. Releaseably securing the canopies 40 & 42 in this fashion has the advantage of making the canopies removable for cleaning, storage, changing color or style, etc.

In one embodiment, the canopy apparatus utilizes a single canopy with a first and second end secured to the first and second translating members 54 as well as a first side defining a loop 48 and a second side defining a loop 48 where the first and second sides are secured within the canopy rails 50. The canopy is secured to the spool rod 52 at a point between the first and second ends, and the canopy may define a loop extending between the first and second sides to accommodate the spool rod 52.

Figure 32:
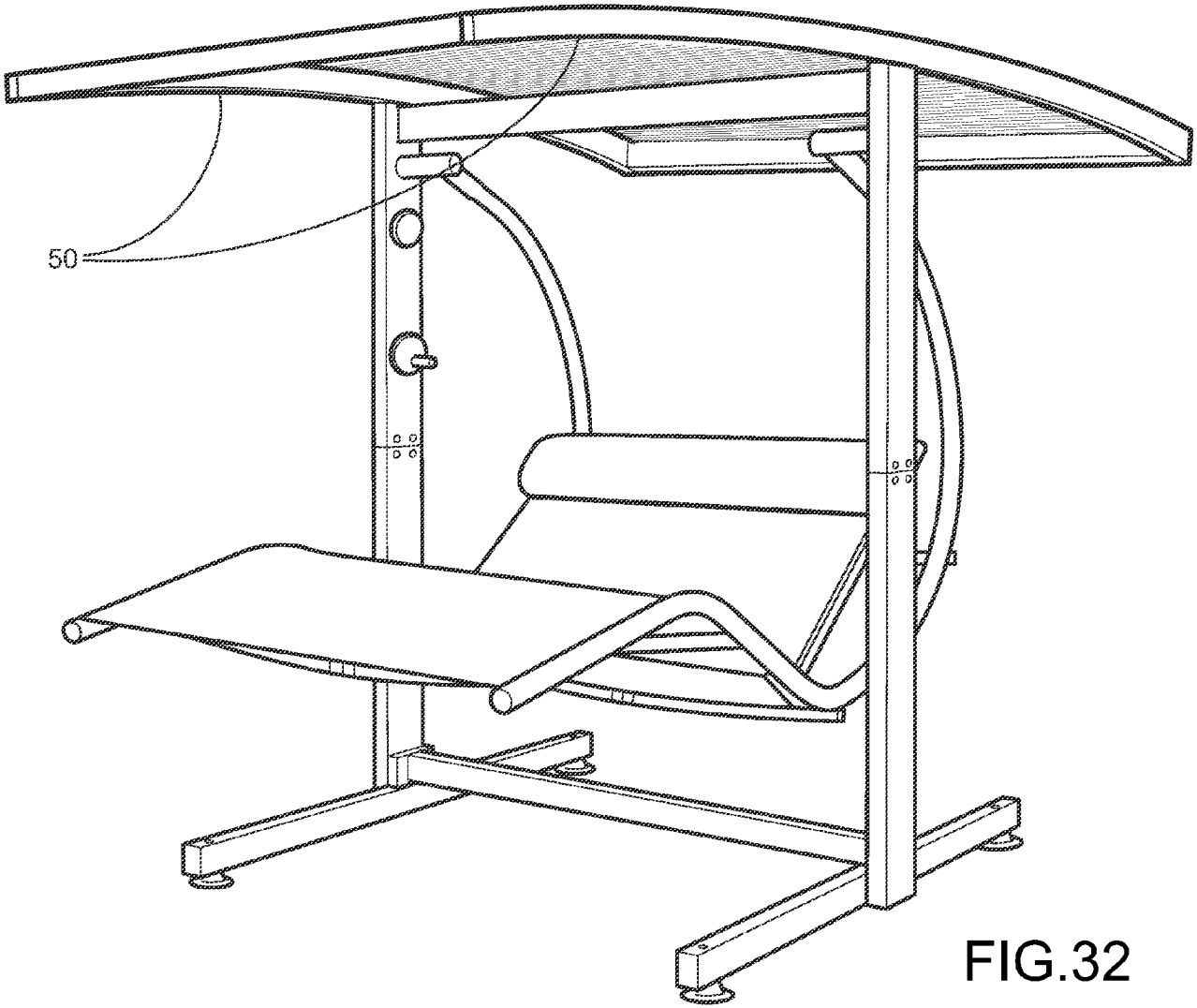
FIG. 32 is an exemplary deployable canopy apparatus with curved canopy rails.

The canopy rails 50 can be formed as a unitary piece with the stanchion 12 or rigidly secured to the stanchion 12 through, for example, welding, fastening, or an adhesive. The canopy apparatus can utilize one canopy rail 50 attached to each stanchion 12 where the canopy 50 rails each include a forward and rearward segment. The forward and rearward segments can be formed as a unitary piece or as two separate pieces releaseably affixed together or affixed to the stanchions 12. The forward and rearward segments can include separate channels 86, slits 88, and other features discussed in more detail below. Alternatively, some embodiments may not utilize stanchions 12 or vertically aligned supports, and the spool rod 52 and one or more transverse support members connect between the first and second canopy rails 50. In yet other embodiments, the canopy apparatus can utilize four canopy rails 50 where each canopy rail 50 has a free end and a fixed end secured to the stanchion 12. The canopy rails 50 can have any suitable cross sectional shape, such as squared, rectangular, or circular similar to the tubular extrusion depicted in FIGS. 9 B & C. The canopy rails 50 can also be bowed or curved along their length, as depicted in the embodiment shown in FIG. 32.

Figure 11:
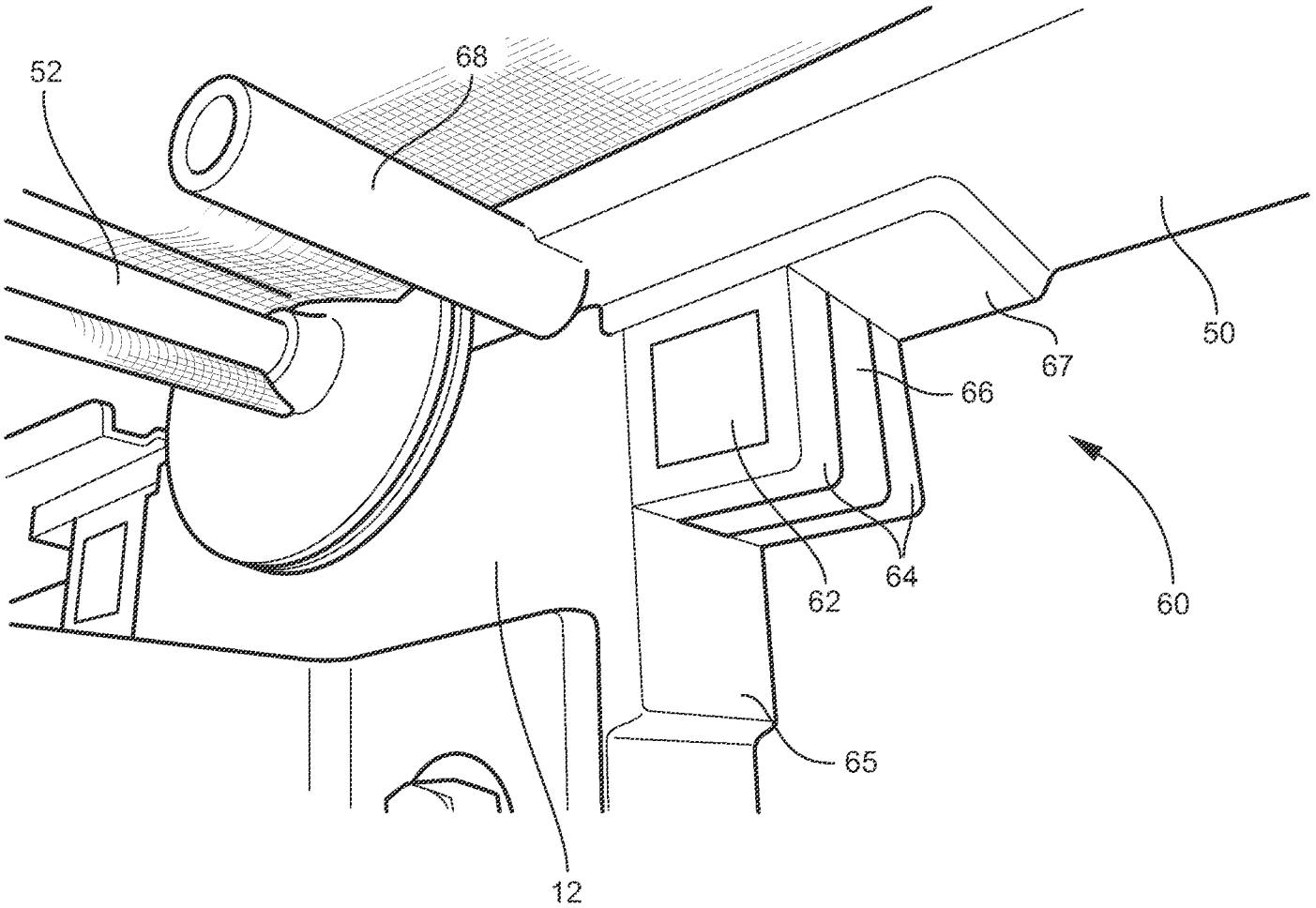
FIG. 11 is an exemplary square hinge.
Figure 12:
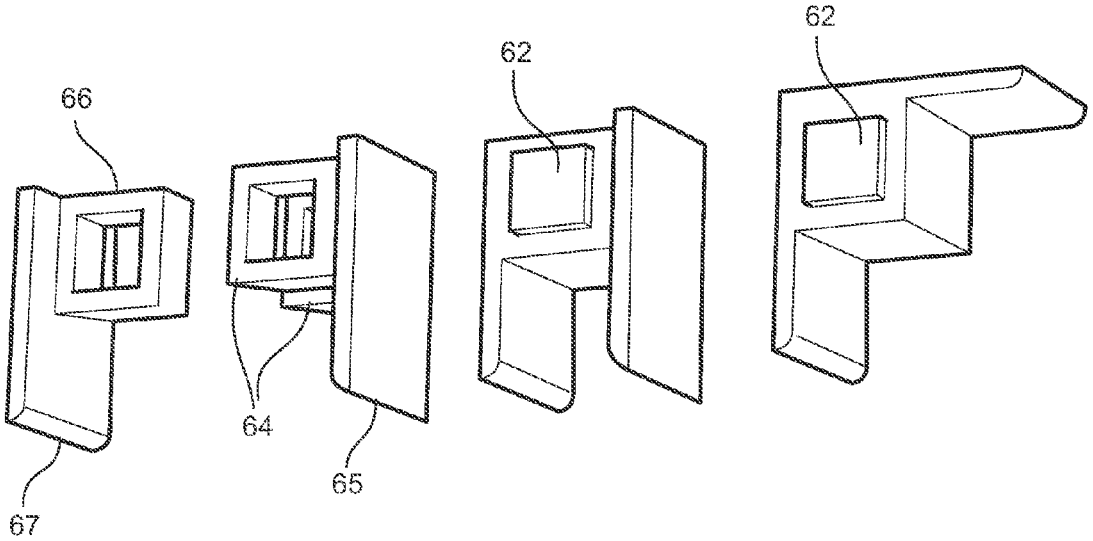
FIG. 12 illustrates vertical displacement of a square hinge.
Figure 13:
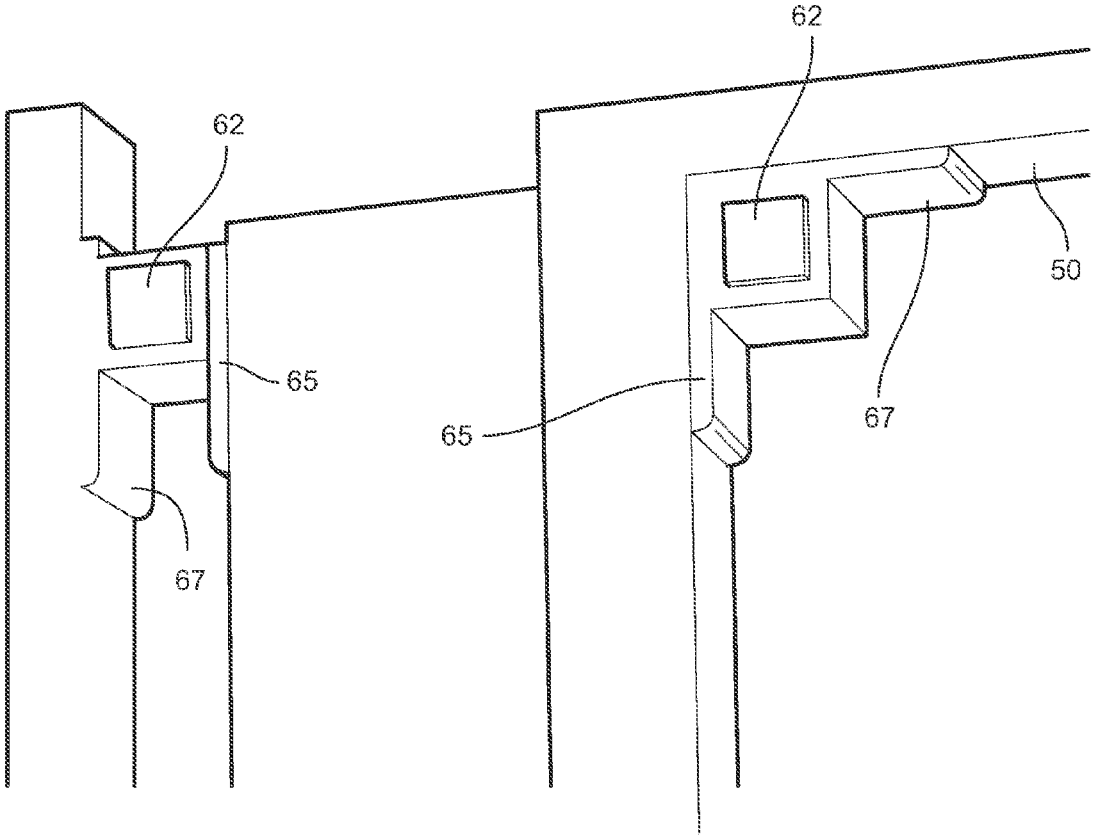
FIG. 13 illustrates displacement of a canopy assembly about a square hinge.

The embodiment depicted in the attached figures utilizes four canopy rails 50 that are hingedly affixed to the stanchions 12 so that the canopies can be raised or lowered. The exemplary canopy rails 50 shown in FIGS. 11 through 13 are secured to the stanchions 12 with a square hinge 60. The square hinge 60 includes a square hinge pin 62 and a square barrel formed from two outer knuckles 64 attached to a first hinge plate 65 that is in turn affixed to the stanchion 12 and a center knuckle 66 attached to a second hinge plate 67 that is in turn affixed to the canopy rail 50. The canopies can be raised or lowered by removing the hinge pin 62, rotating the canopy assembly upward or downward by approximately ninety degrees as shown in FIG. 12, and reinserting the hinge pin 62 to lock the hinge into place. The resulting upward (i.e., deployed) and downward (i.e., stowed) canopy positions are illustrated in FIG. 13.

Figure 14:
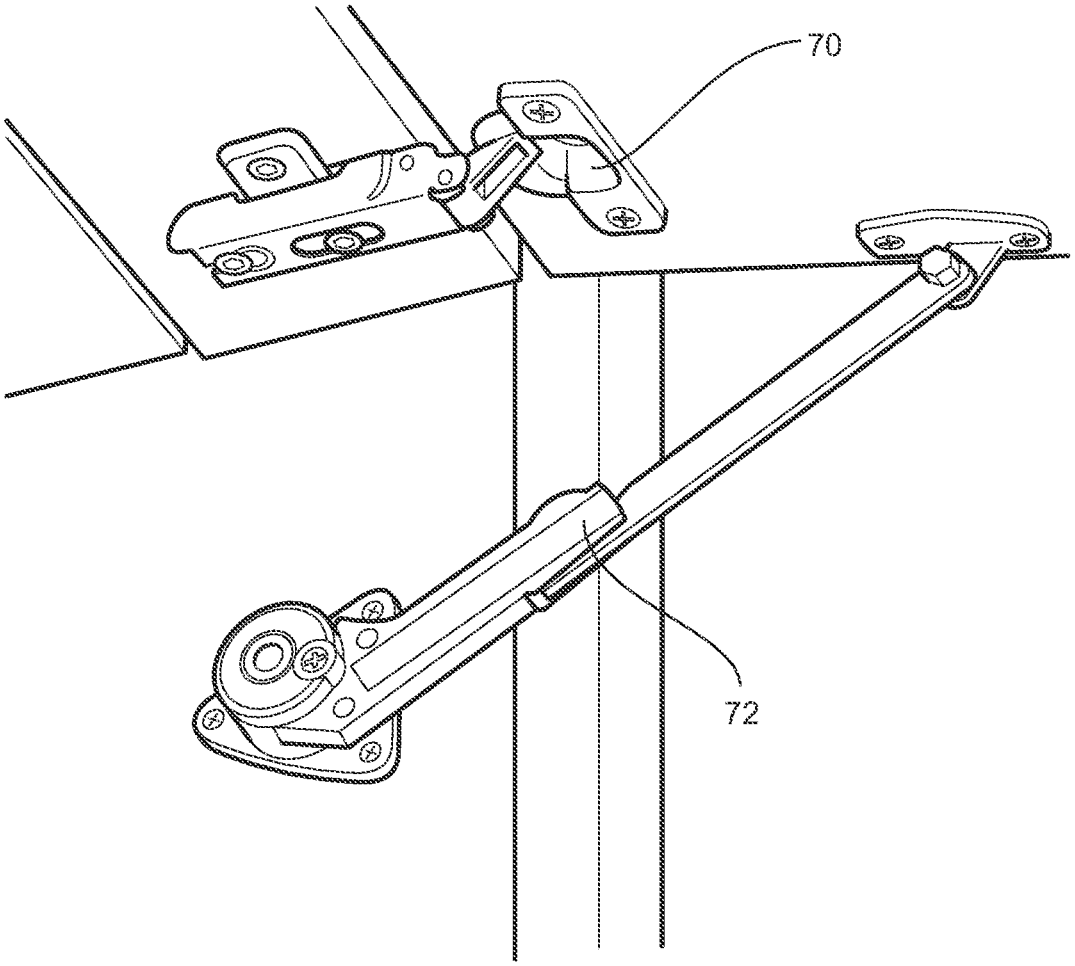
FIG. 14 is an exemplary overlay hinge and soft-down-stay assembly.
Figure 15:
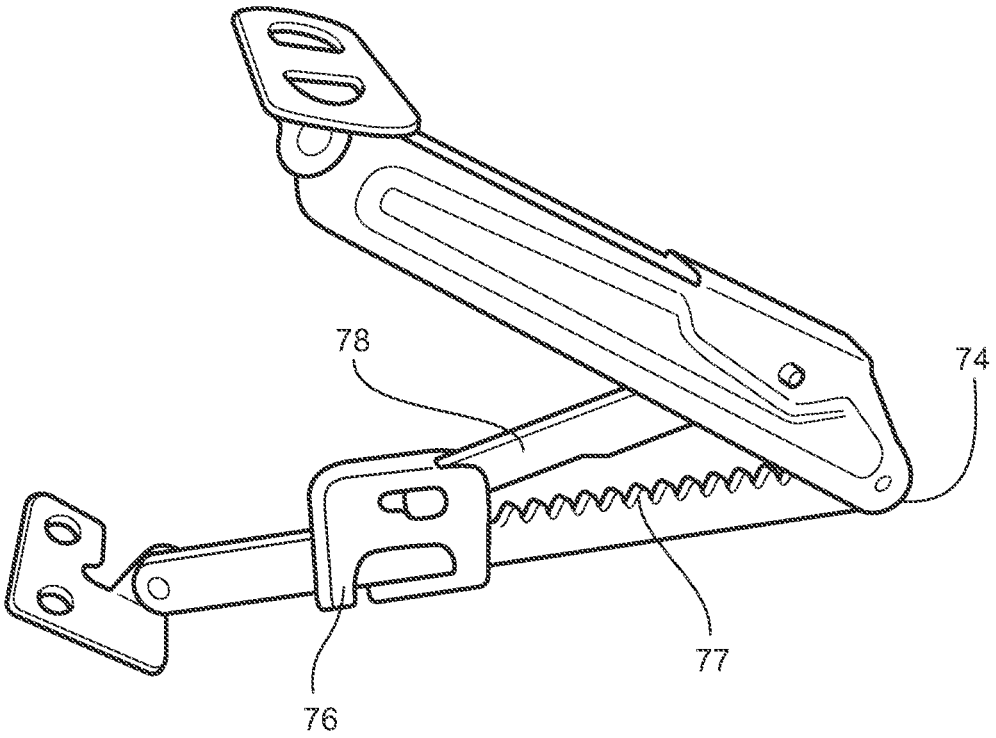
FIG. 15 is an exemplary locking hinge.

Those of skill in the art will appreciate that FIGS. 11-13 are not intended to be limiting, and other types of hinges and accompanying hardware can be used that permit the canopy to be locked into various vertical displacements. As an example, the overlay hinge 70 and soft-down-stay 72 assembly shown in FIG. 14 is configured to hold the canopy in an upward deployed position while permitting a smooth, gentle transition to a stowed position when pulled downward. As another example, the locking hinge 74 of FIG. 15 is used to place the canopy into a discrete number of vertical displacements by moving the canopy to the desired position and engaging the locking piece 76 with a position on the rack 77 to hold the locking member 78 into position.

Figure 16A:
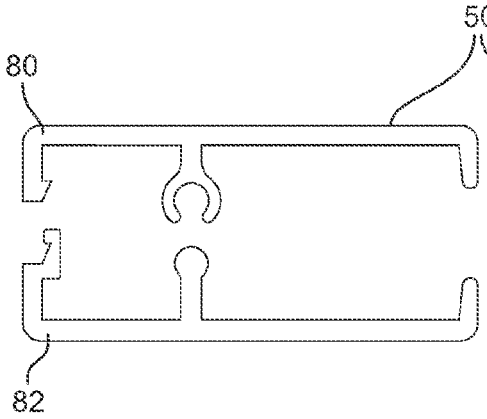
FIGS. 16A and 16B is an exemplary canopy rail.
Figure 16B:
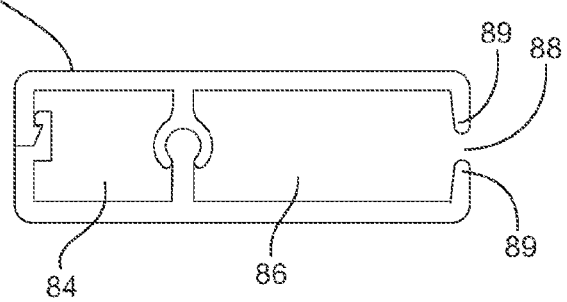
Figure 18:
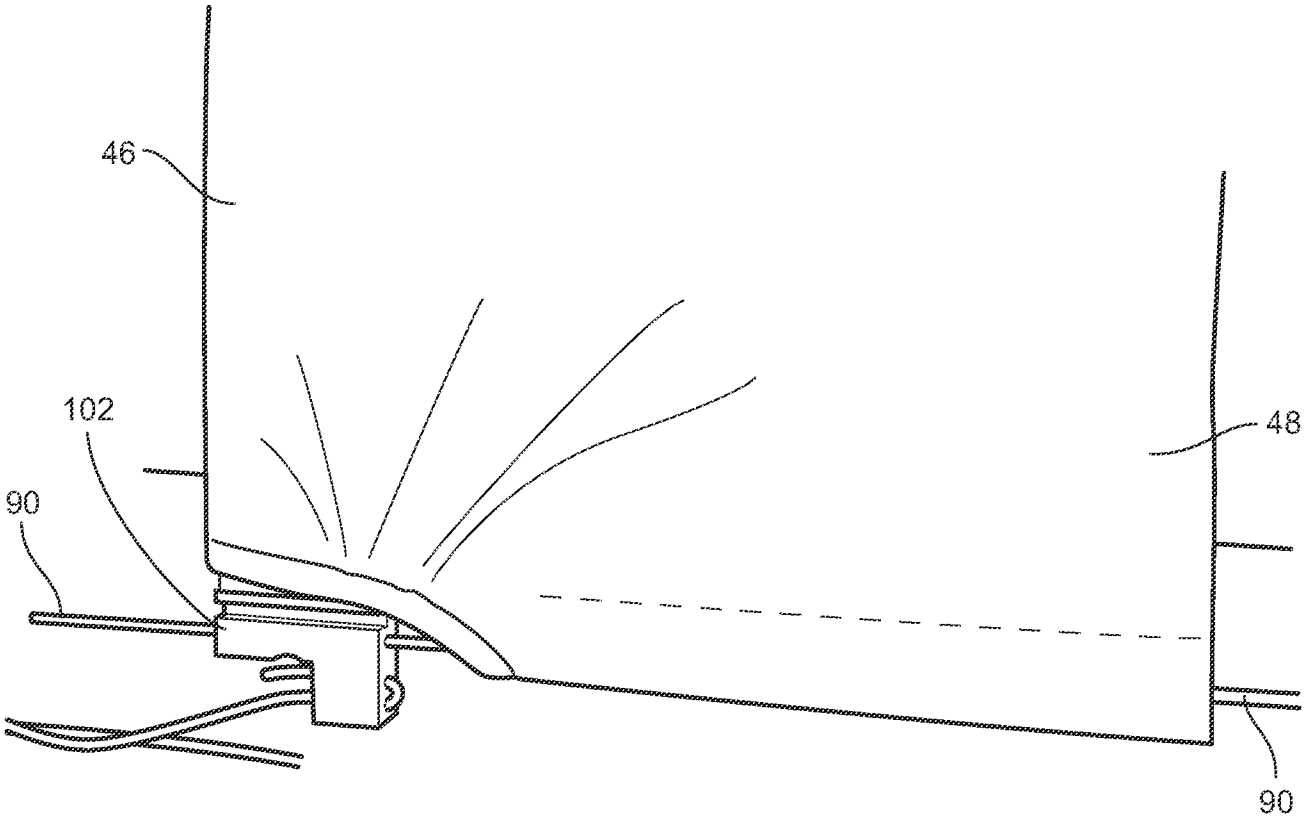
FIG. 18 illustrates an exemplary retaining member extending through a canopy loop.
Figure 19:
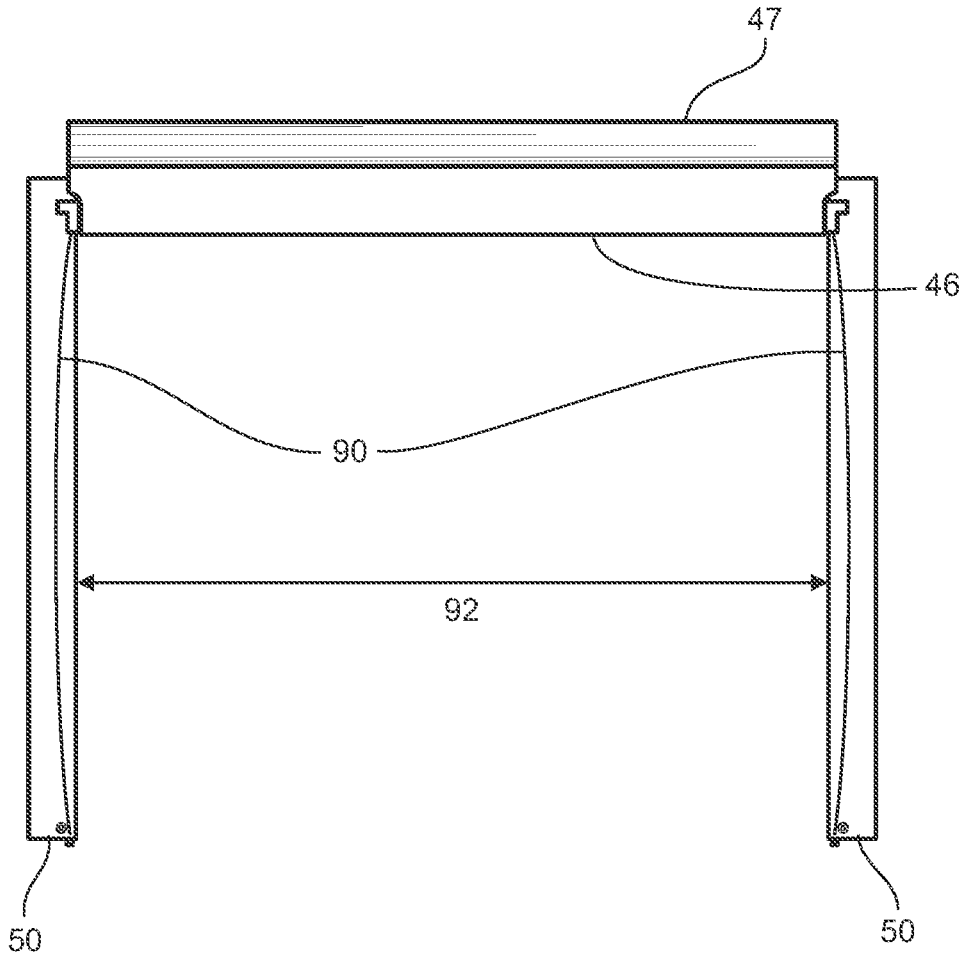
FIG. 19 illustrates a canopy in the retracted position.

Retaining the canopy within the canopy rails 50 can be described with reference to FIGS. 16A & B through FIG. 19. The canopy rails 50 can be formed with a top portion 80 and a bottom portion 82, as depicted in FIGS. 16A & 16B, or the canopy rails 50 can be formed as a single, unitary rail segment, such as the canopy rail 50 shown in FIGS. 17 & 18. The canopy rails 50 include an enclosed channel 84 and a c-channel 86 that run the length of the canopy rail 50 from the fixed end 49 to a free end 51 of the canopy rail 50.

Figure 17:
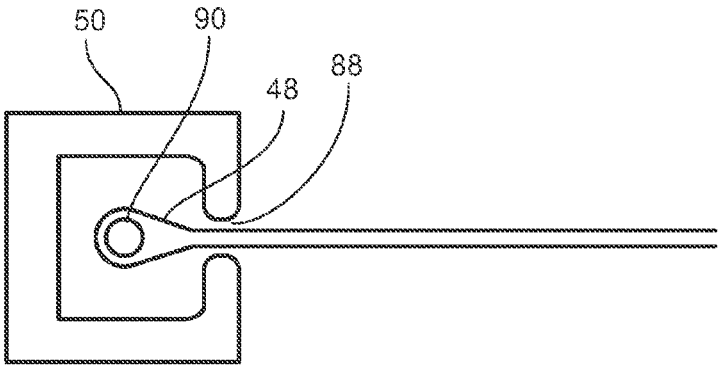
FIG. 17 illustrates a canopy loop and retaining member within a canopy rail channel.

The c-channel 86 retains the canopy and is formed with a slit 88 that runs along the length of the canopy rail 50 and that is defined by opposing shoulders 89. The first 44 and second 45 sides of the canopy terminate in a loop 48 formed, for instance, by folding the canopy over itself and sewing or otherwise securing the canopy to itself. The loop 48 is inserted into the c-channel slit 88, and a retaining member 90 is passed through the loop 48 within the c-channel 86 as illustrated in FIGS. 17 and 18. The retaining member 90 has a dimension larger than the width of the slit 88 so that the retaining member 90 and loop 48 are retained within the c-channel 86, as depicted in FIG. 17. The retaining member 90 can have any suitable cross section (e.g., a circular, rectangular, hexagonal) and be formed, for example, as a resilient, flexible cord or a rigid rod.

Figure 20:
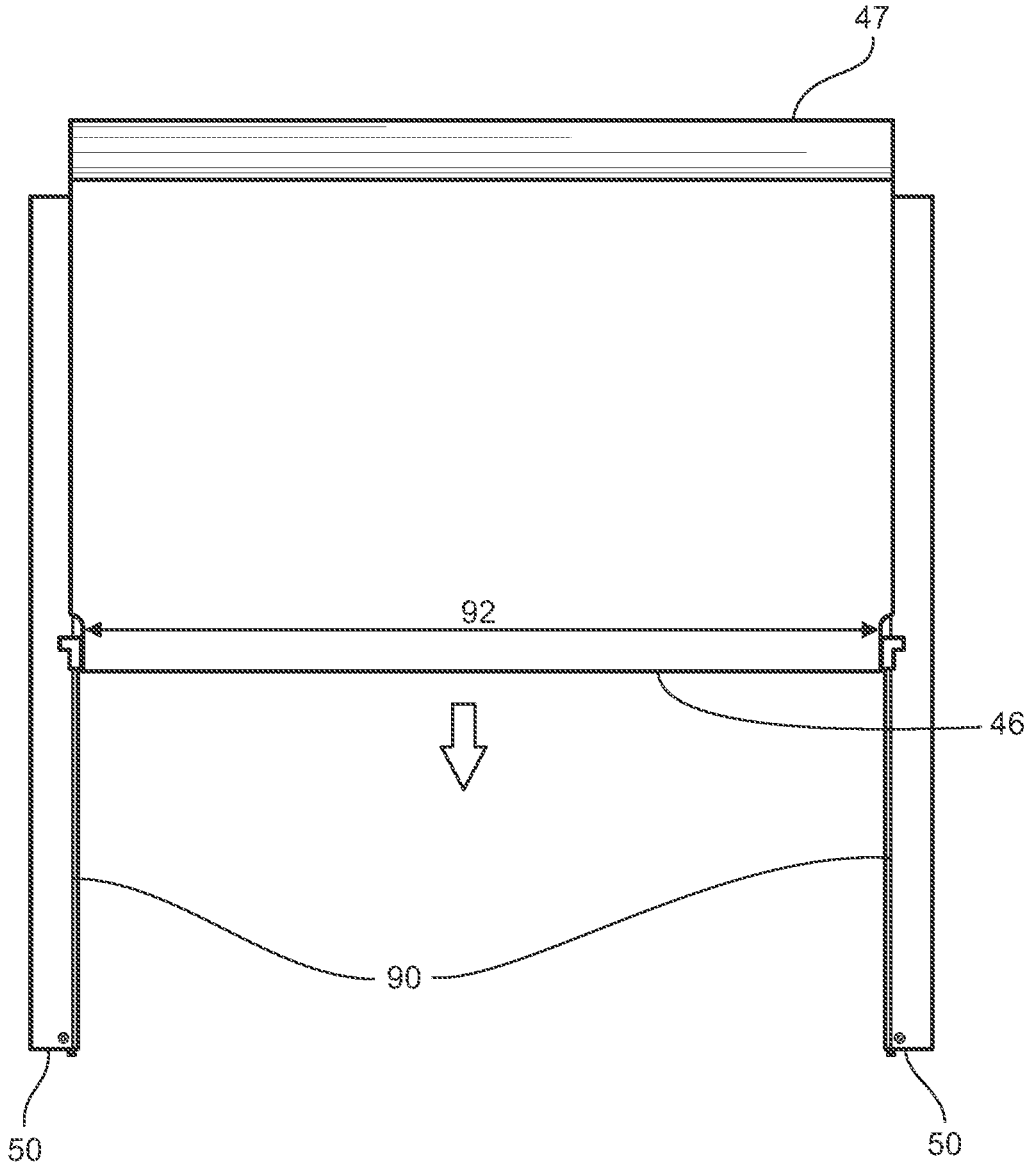
FIG. 20 illustrates a canopy in a deployed position and deflection of spring rods.

In one embodiment, the retaining members 90 are formed as spring rods that provide a bias, which holds the canopy taut when the canopy is at least partially deployed. When the canopy is in the fully retracted state depicted in FIG. 19, the spring rods 90 exhibit a curvature and are partially deflected within the canopy rail c-channel 86. The canopy is sized such that the distance between the first side 44 and the second side 45 is smaller than the distance between the mid-points 92 of the spring rods 90 in the deflected position. As the canopy is deployed, the curvature of the spring rods 90 applies tension to the canopy that holds the canopy in a taut, substantially flat position. The canopy exerts an equal and opposite force on the spring rods 90 that reduces the curvature of the spring rods 90, as depicted in FIG. 20, as the canopy approaches the midpoint 92 of the spring rods 90. When the canopy is fully deployed, the spring rods 90 return to the curved state. The bias exerted by the spring rods 90 depends on, inter alia, the materials used to construct the spring rod 90 and the deflection of the spring rod 90. In the embodiment shown in the attached figures, the spring rod 90 is formed from one-quarter inch steel, and the midpoint 92 of the spring rod 90 deflects approximately one and a half inches within the c-channel 86 with the canopy is in the fully retracted position.

The canopy moves between the deployed and retracted states as the translating member 54 translates along the length of the canopy rails 50 via a translation drive assembly. Canopy deployment and retraction is better understood with reference to FIGS. 22 & 23, which depict exemplary an exemplary translation drive assembly and actuation assembly. The translation drive assembly depicted in the attached figures utilizes four sliders 102—a slider 102 associated with the canopy first side 44 and a slider associated and the canopy second side 45 for each of the forward 40 and rearward 42 canopies. The sliders 102 include: a guide block 104 with a first 106 and second 108 cable aperture and a retaining member bore 110 formed therethrough; a groove 112 that accommodates a canopy rail slit 88, and a coupling piece 114 that is configured to couple to the translation member 54. The ends of the translating member 54 and/or the slider 102 include an angled feature 55, as shown in FIG. 10B, so that the translating member 54 does not entirely abut the slider 102. In this manner, the translating member 54 and slider 102 can move slightly relative to one another to help militate against the translating member 54 getting stuck while translating along the canopy rails 50.

A spindle assembly includes a spindle 116, a spindle post 118, and spindle cover 120. End caps 122 are coupled to the fixed end 49 and or free end 51 of the canopy rails 50 and help secure the spring rod 90 within the c-channel 86. The ends of the spring rod 90 are threaded and extend partially through an aperture 124 in the end caps 122. Locking nuts 126 secure the spring rod 90 ends to the end caps 122. The end caps 122 are secured to the canopy rail 50 using screws, bolts, rivets, or any suitable fastener or affixing means known to one of skill in the art.

The spring rod 90 runs through the retaining member bore 110 in the slider 102, and the slider grooves 112 accommodate the shoulders 89 of the canopy rail slit 88 so that the slider 102 can translate within the c-channel 88 along the length of the spring rod 90. The cable 130 runs through the c-channel 86 and the first slider cable aperture 106, loops around the spindle 116, and runs back through the second slider guide block cable aperture 108. The cable 130 is secured to the slider second cable aperture 108 by, for example, the cable locks 128 shown in FIG. 21 that are crimped about the cable 130.

Figure 21:
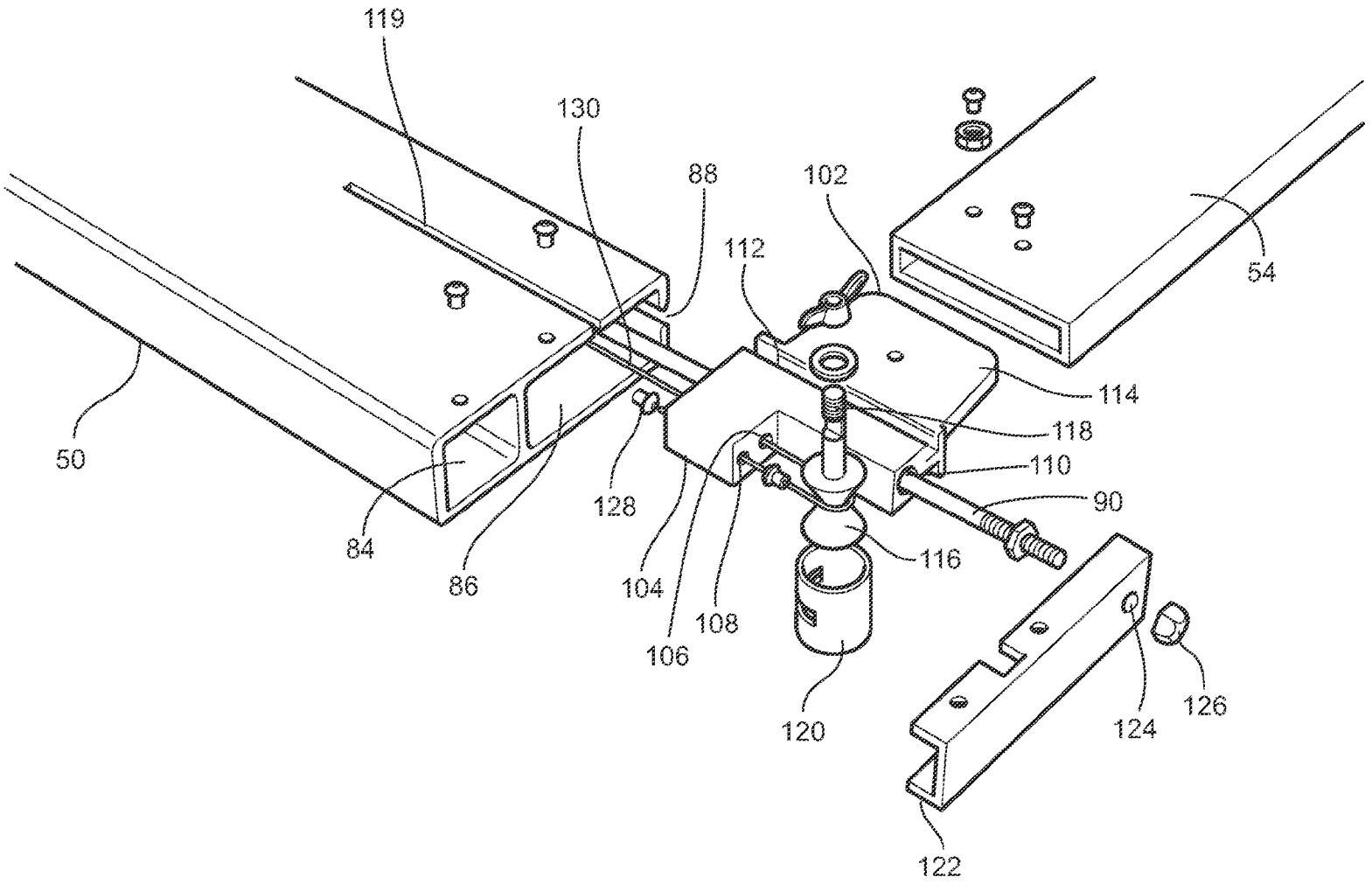
FIG. 21 is an exploded view of an exemplary slider and spindle assembly.

The spindle post 118 is inserted into a slot 119 that extends partially along the length of the c-channel 86 and held in place by fastener hardware, such as the washer and wing nut shown in FIG. 21. The slot 119 restricts lateral movement of the spindle assembly while permitting the spindle assembly to be located at different positions along the length of the canopy rail 50, thereby permitting control over the extent of the canopy deployment along the canopy rails 50 and allowing additional cable length as needed when moving the canopy assembly downward to the stowed position. As the cable 130 moves within the c-channel 86, the spindle 116 rotates about the spindle post 118. Force applied to the cable 130 keeps the cable 130 frictionally engaged to the spindle 116 while the cable 130 moves. The spindle cover 120 helps ensure that the cable 130 does not become completely disengaged from the spindle assembly such that the cable 130 is no longer looped around the spindle 116 as well as ensures that the slider 102 does not engage the spindle 116 to impede its rotation.

Figure 22:
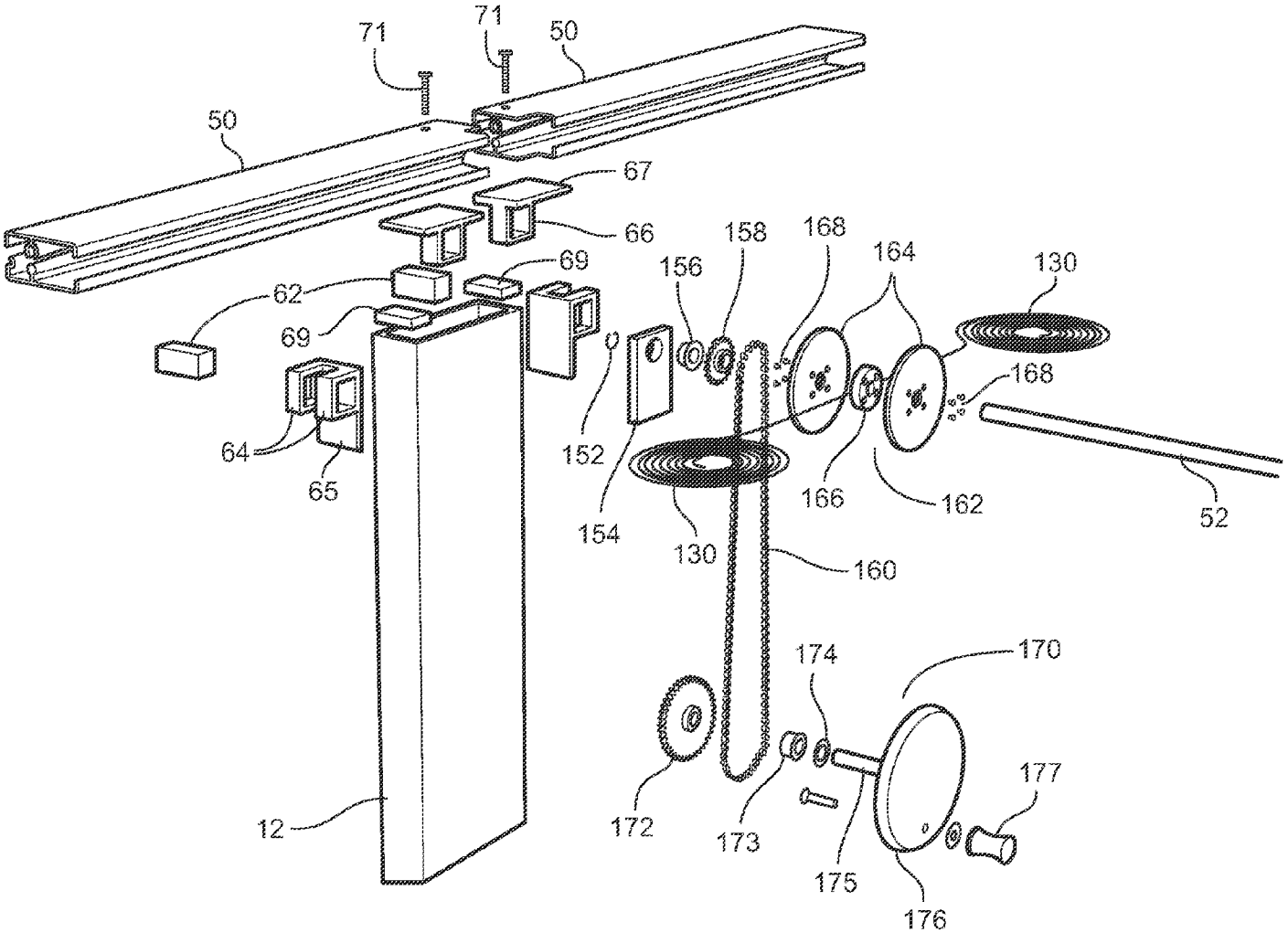
FIG. 22 is an exploded view of an actuator assembly.
Figure 23:
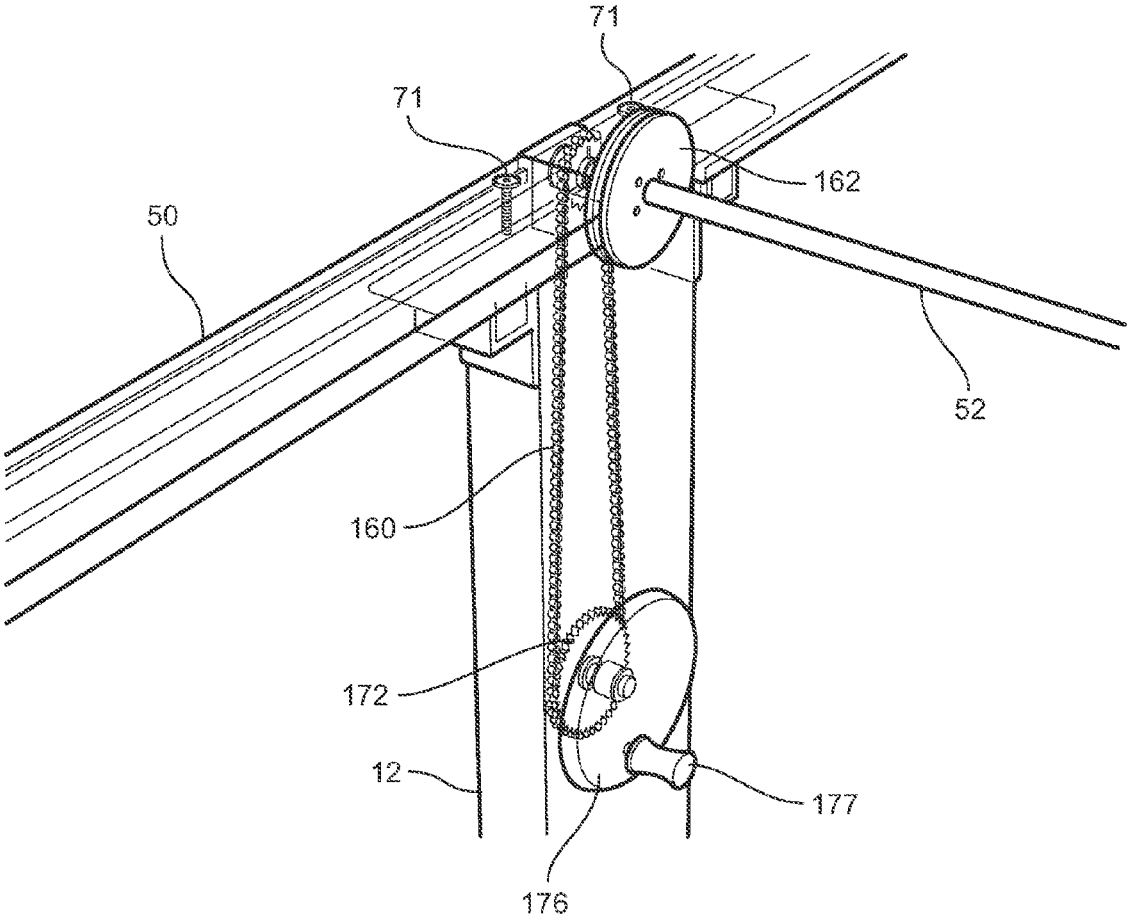
FIG. 23 is an assembled view of an actuator assembly.

The actuation assembly shown in FIGS. 22 & 23 includes a spool rod c-clip 152; an axil tower 154; a spool bushing 156; a spool sprocket 158; a chain 160; a cable spool 162 having a first and second cable spool plate 164, a cable spool hub 166, and optionally, fasteners 168 securing the cable spool plates 164 to the cable spool hub 166 in embodiments where the cable spool plates 164 are not formed as a unitary piece with the cable spool hub 166; a spool rod 52; a crank assembly 170 having a sprocket 172, a crank bushing 173, one or more crank washers 174, a crank axil 175, a crank wheel 176, and a crank handle 177. The axil towers 154 are partially housed within the stanchions 12, and the spool rod 52 runs through bores in the axil towers 154 and is secured to the axil towers 154 with the spool rod c-clips 152. The spool bushings 156, spool sprockets 158, and cable spool assemblies 162 are assembled about the spool rod 52 and held in place in part with spring pins.

The crank sprocket 172 is housed within the stanchion 12, and the crank bushing 173, washers 174, and crank wheel 176 are assembled about the crank axil 175. The chain 160 is housed within the stanchion 12 and places the crank sprocket 172 in mechanical communication with the spool sprocket 158 such that as the crank assembly 170 is rotated using the crank handle 177, the cable spool assembly 162 and spool rod 52 also rotate. The crank sprocket 172 is sized larger than the spool sprocket 158 such that a single rotation of the crank wheel 176 results in multiple rotations of the cable spool assembly 162 and spool rod 52. Instead of a chain with crank and spool sprockets 172 and 158, a combination of belts and pulleys could also be used.

Figure 24:
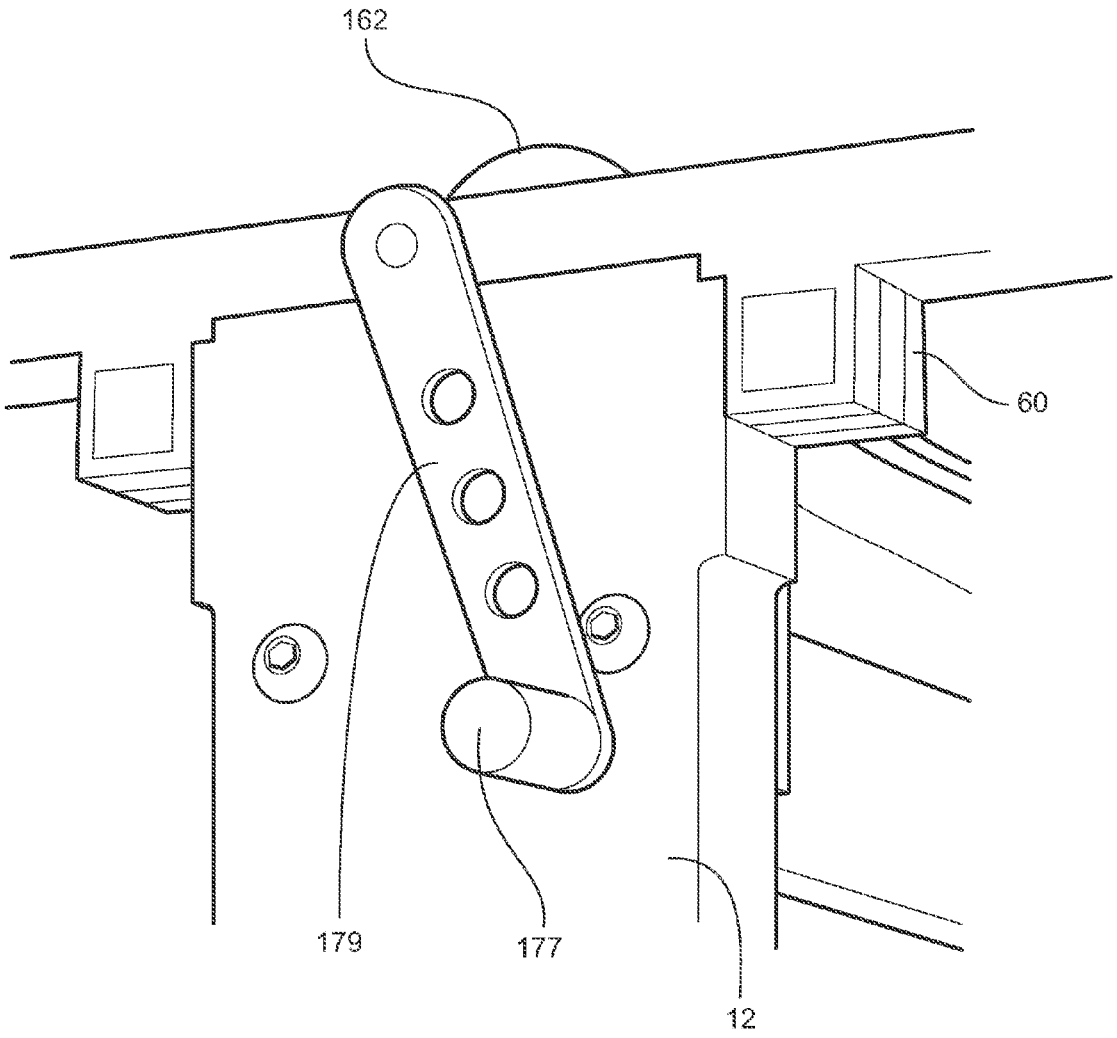
FIG. 24 is an exemplary actuator for rotation of the spool rod.

The actuation assembly depicted in FIGS. 22 & 23 has the advantage of being accessible from the chair 8 of FIG. 1. But skilled artisans will appreciate that other actuation mechanisms can be used, such as the crank arm 179 and crank handle 177 attached directly to the spool rod 52 shown in FIG. 24, or an electric motor in mechanical communication with the spool rod 52 and controlled by an electric switch.

The cables 130 facilitate mechanical communication between the sliders 102 of the forward canopy 40 and the sliders 102 of the rearward canopy 42 at the first and second canopy sides 44 & 45. A first cable 130 runs from the slider 102 associated with the forward canopy 40 first side 44 to the corresponding slider 102 associated with the rearward canopy 42 first side 44 through the corresponding c-channels 86 of the canopy rails 50 and through a passage in a first spool hub 166. Likewise, a second cable 130 runs from the slider 102 associated with the forward canopy 40 second side 45 to the corresponding slider 102 associated with the rearward canopy 42 second side 45 through the corresponding c-channels 86 of the canopy rails 50 and through a passage in a second spool hub 166. The spool hub 166 includes a one-way bearing that is engaged when the cable 130 is being spooled about the hub 166 but disengaged as the cable 130 is unspooled.

When the canopy is in the fully deployed position, a length of each cable 130 is spooled around the spool hub 166, and the unspooled cable 130 portion is at its shortest length, as measured from the spool hub 166, through the c-channel 86, through the first cable aperture 106, around the spindle 116, and to the second cable aperture 108. As the crank handle 177 is rotated, the spool rod 52 also rotates, thereby wrapping both the forward 40 and rearward 42 canopies around the spool rod 52 in a nested, or spiraled configuration. Canopy deflectors 68, such as the deflector 68 shown in FIGS. 3 & 11, can optionally be utilized to ensure that the canopy does not deflect too far upward or downward and become frictionally engaged or caught on the edges of the canopy rail 50 as the canopy is spooled around the spool rod 52.

As the canopies become wrapped about the spool rod 52, a tension is created in the canopies that operates on the translating members 54 and causes the translating members 54 and sliders 102 to translate along the canopy rails 50 towards the spool rod 52. The cables 130 are likewise placed under tension as the translating members 54 translate, and the cables 130 become unspooled from the cable spool hubs 166. When the canopies are in the fully retracted, or stowed, position, the unspooled cable 130 portion is at its greatest length.

If the crank handle 177 is then rotated in the opposite direction, the cables 130 begin to spool around the cable spool hubs 166, thereby placing the cables 130 under tension. The tension is transferred to the slider 102 at the second cable aperture 108, and the sliders 102, translating members 54, and canopies begin to translate along the canopy rails 50 away from the spool rod 52 in the direction of the canopy rail free ends 51.

Skilled artisans will recognize that the embodiments shown in the attached figures and described above are not intended to be limiting, and other translation drive assemblies can be used to implement the present invention. For example, in one embodiment, the translation drive can utilize a worm-gear configuration where sprockets assembled about the spool rod 52 drive worm gears that extend along the length of the canopy rails 50 and through a threaded bore in the sliders 102. When a crank handle 177 or other actuator rotates the sprocket, the worm gear translates the slider 102 along the length of the canopy rail 50. In yet another embodiment, the translation drive can include sprockets or pulleys affixed to the sliders 102 that are connected by a chain or belt to sprockets or pulleys assembled about the spool rod 52 such that the sliders 102 translate when a crank handle 177 or other actuator is rotated. A combination of servo motors connected to the sliders via chains or belts could also be used to translate the sliders and deploy or retract the canopies. These are just a few non-limiting examples of translation drive configurations that can be utilized to implement the present invention.

Figure 25:
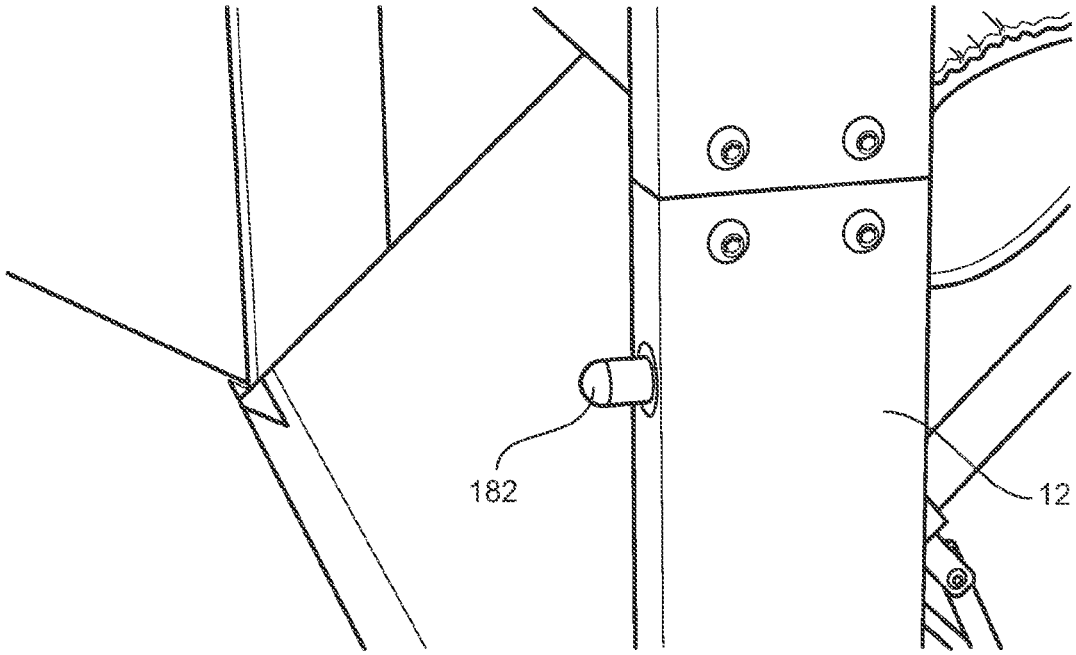
FIG. 25 is an exemplary support handle secured to a canopy support in a retracted position.
Figure 26:
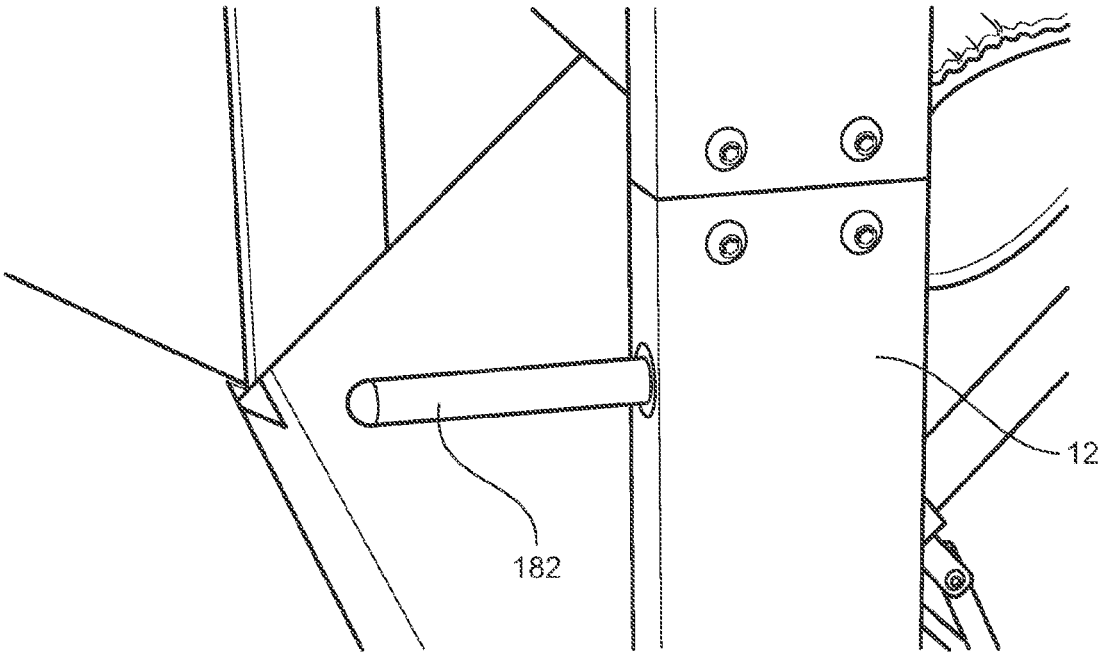
FIG. 26 is an exemplary support handle secured to a canopy support in an extended position.

Other embodiments may include features, like the exemplary support handle 182 shown in FIGS. 25 and 26 in the retracted and extended positions, respectively. The support handles 182 extend outwardly from a surface of the stanchions 12 and can be retracted and stowed within the stanchions 12 when not in use.

Figure 27:
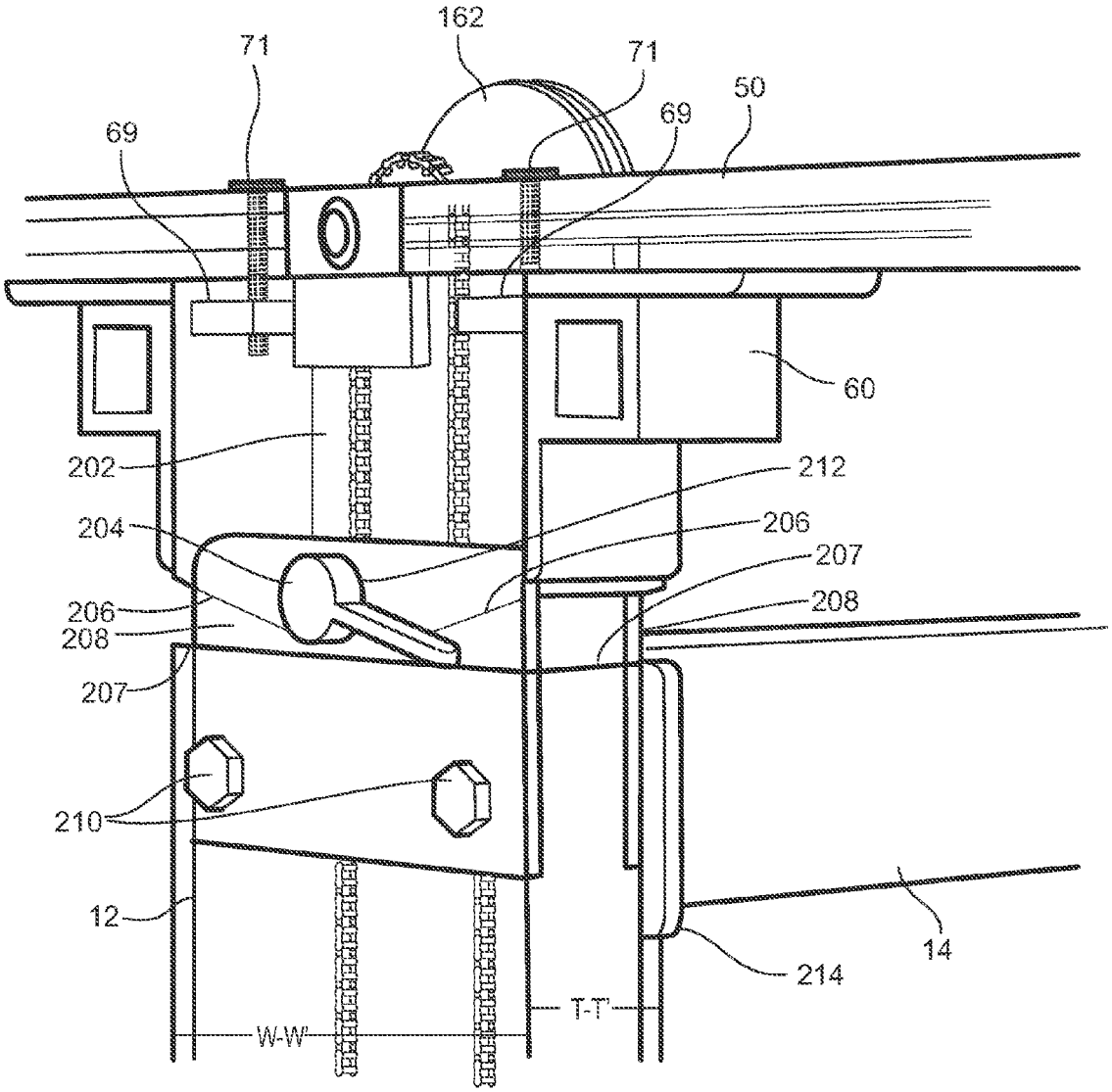
FIG. 27 is an exemplary tilt assembly according to one embodiment of the invention.
Figure 28:
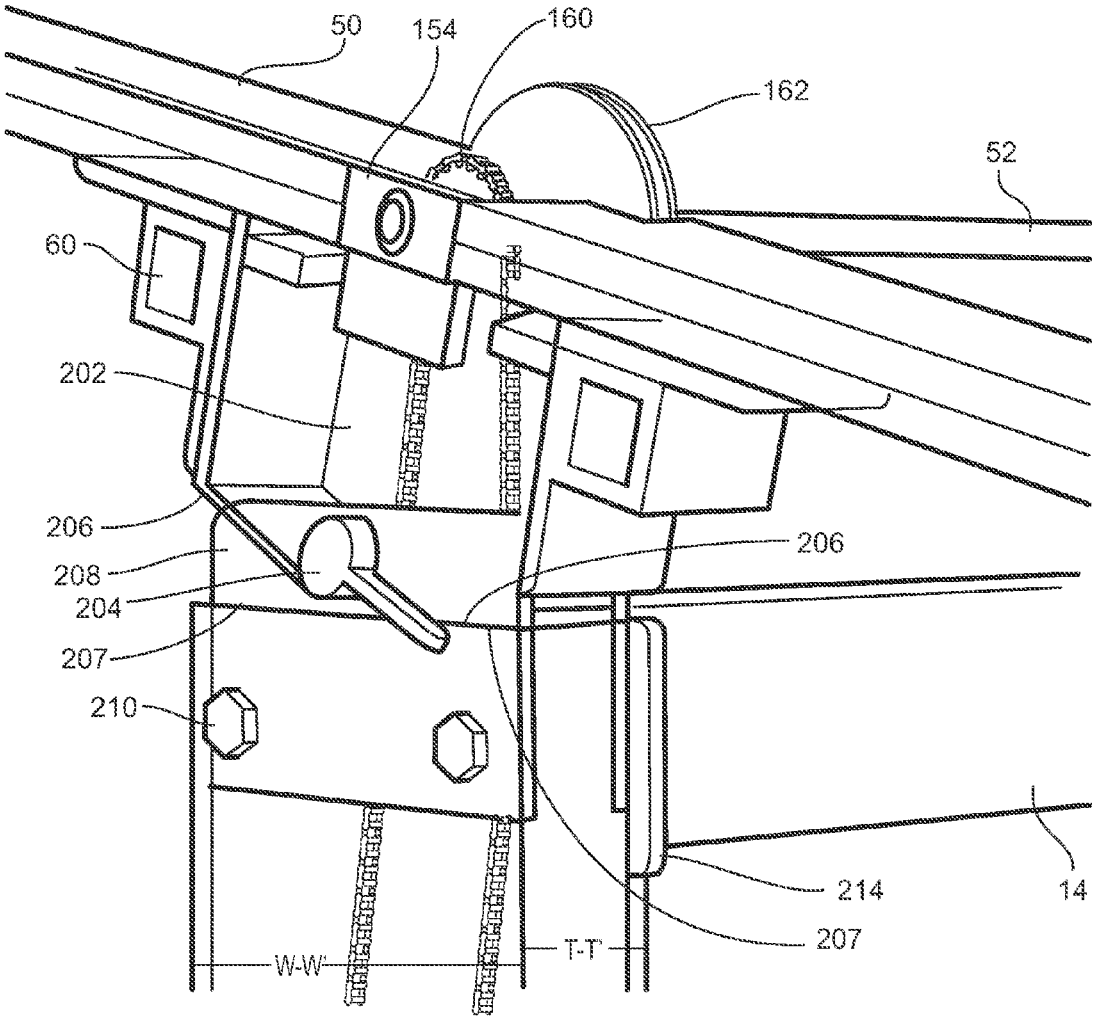
FIG. 28 is an exemplary tilt assembly in the tilted configuration.

In yet another embodiment, the forward canopy 40 and rearward canopy 42 are configured to tilt forward and backward about the stanchions 12, as shown in FIGS. 27 & 28, utilizing a canopy tilt assembly. The canopy tilt assembly includes a tilting portion 202 with tilt surfaces 206, a tilt lock 204, and a tilt stop 207. The tilt assembly can further include one or more washers or spacers 212, a spacer block (not shown), and a tilt bracket 208 secured to the stanchions 12 with rivets, threated fasteners, anchors, welding, soldering, an adhesive, or any suitable affixing means. For the embodiment shown in FIGS. 27 & 28, the tilt brackets 208 are secured to the stanchions 12 with threated fasteners 210 that run through the stanchions 12 and through transverse support plates 214 that secure the transverse support members 14 to the stanchions 12. The tilting portion 202 is affixed to the tilt brackets 208 with the tilt lock 204 that can be, for instance, a winged nut or knob with one, two three, four, or any suitable number of wings or lobes, or the tilt lock 204 can be a releasable toggle clamp or any other releasable fastener capable of securing the tilting portion 202 in place.

The canopy is tilted by releasing the tilt lock 204 and tilting the canopy assembly forward or rearward until one of the tilt surfaces 207 frictionally engages the tilt stop 206, as depicted in FIG. 28. The tilt stop 206 can be the top, outer edge of the stanchion 12, or the tilt stop 206 can be configured as a separate piece affixed to the stanchion 12. In one embodiment, the tilting portion 202 has a width that is smaller than the width W-W' of the stanchion 12 such that the tilting portion 202 is housed partially within the stanchion 12 and secured with the tilt lock 204. The tilt stop 206 can then be formed as a spacer block affixed to the inside of the stanchion 12 by the fasteners 210 with a thickness that corresponds to the inner thickness T-T' of the stanchion 12. In this manner, the tilt stop 206 not only provides a surface to frictionally engage the tilting surface 207, but it provides structural support to the stanchion 12 mitigating structural deformation or crushing of the stanchion 12 along its thickness T-T' when the tilt lock 204 is tightened.

The forward canopy 40 and rearward canopy 42 can be stabilized with the threaded rail anchor 69 and fastener 71 shown in FIGS. 22, 23, and 27. The threaded rail anchor 69 can be affixed to the interior of the stanchion 12 through, for instance, welding, soldering, or an adhesive. A fastener 71 is threaded through a bore in the canopy rail 50 and a bore in the threaded rail anchor 69, thereby providing further support for the canopy rails 50 and holding the canopy rails 50 in a squared, or substantially level, position.

Figure 29:
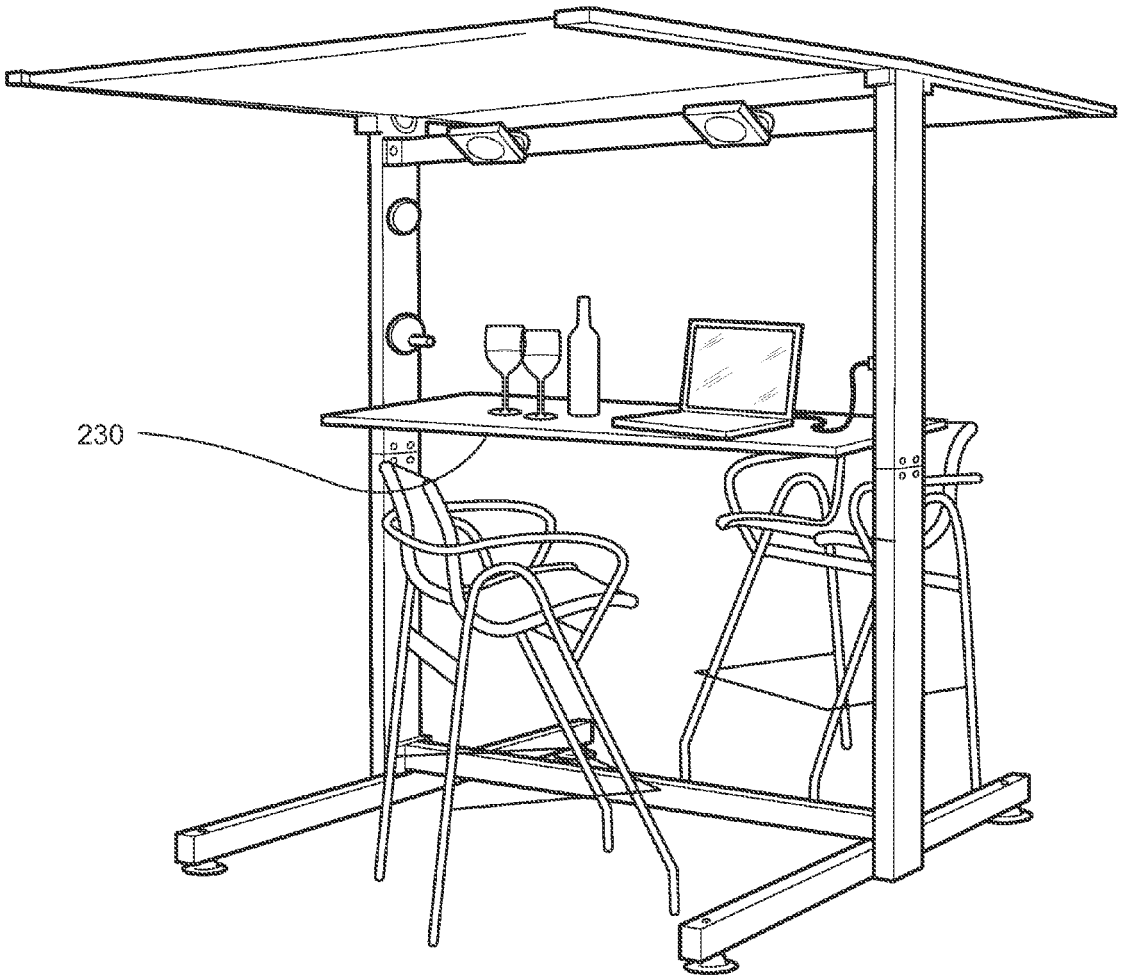
FIG. 29 is an exemplary canopy assembly with a table affixed to the support members.
Figure 30:
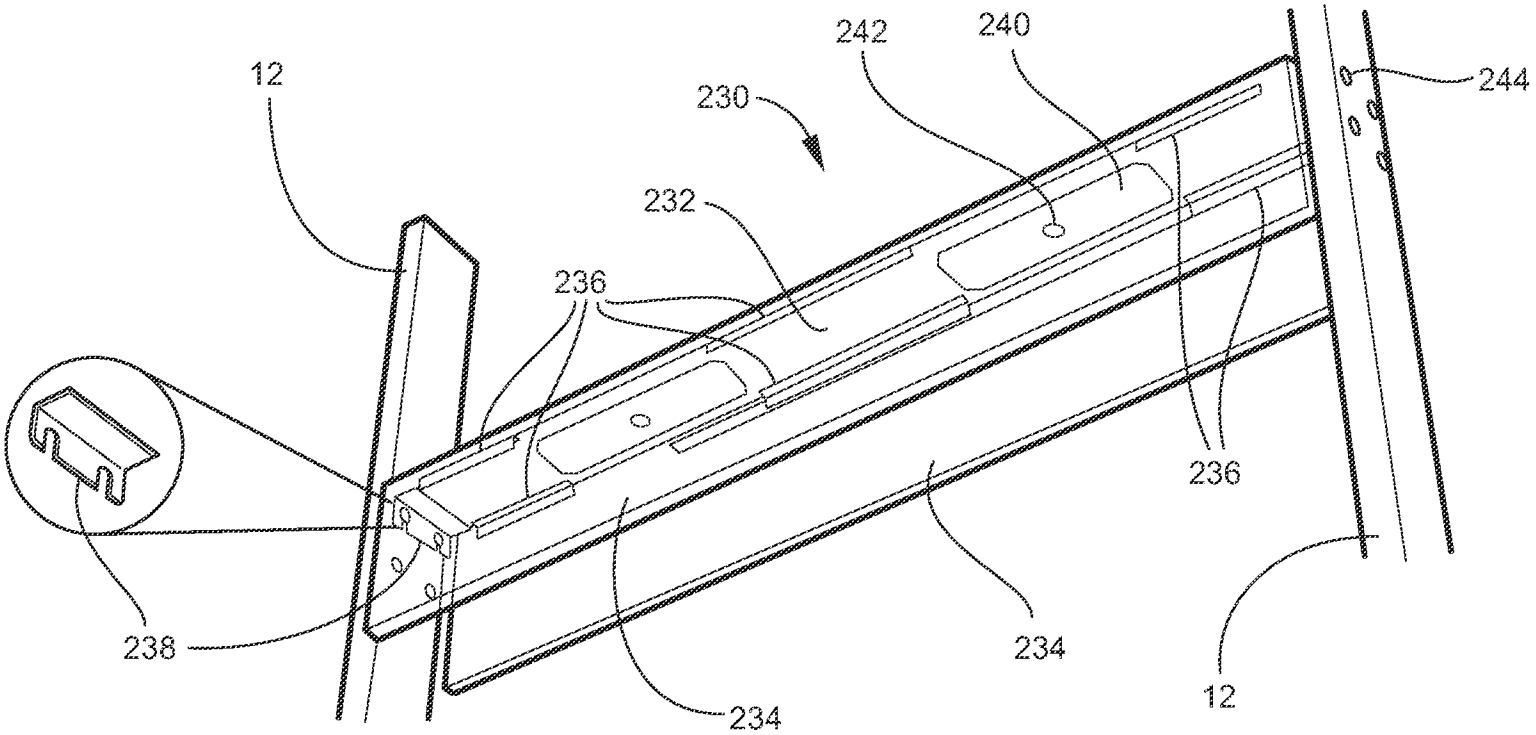
FIG. 30 is an exemplary canopy assembly with a table affixed to the support members in a folded configuration.
Figure 31:
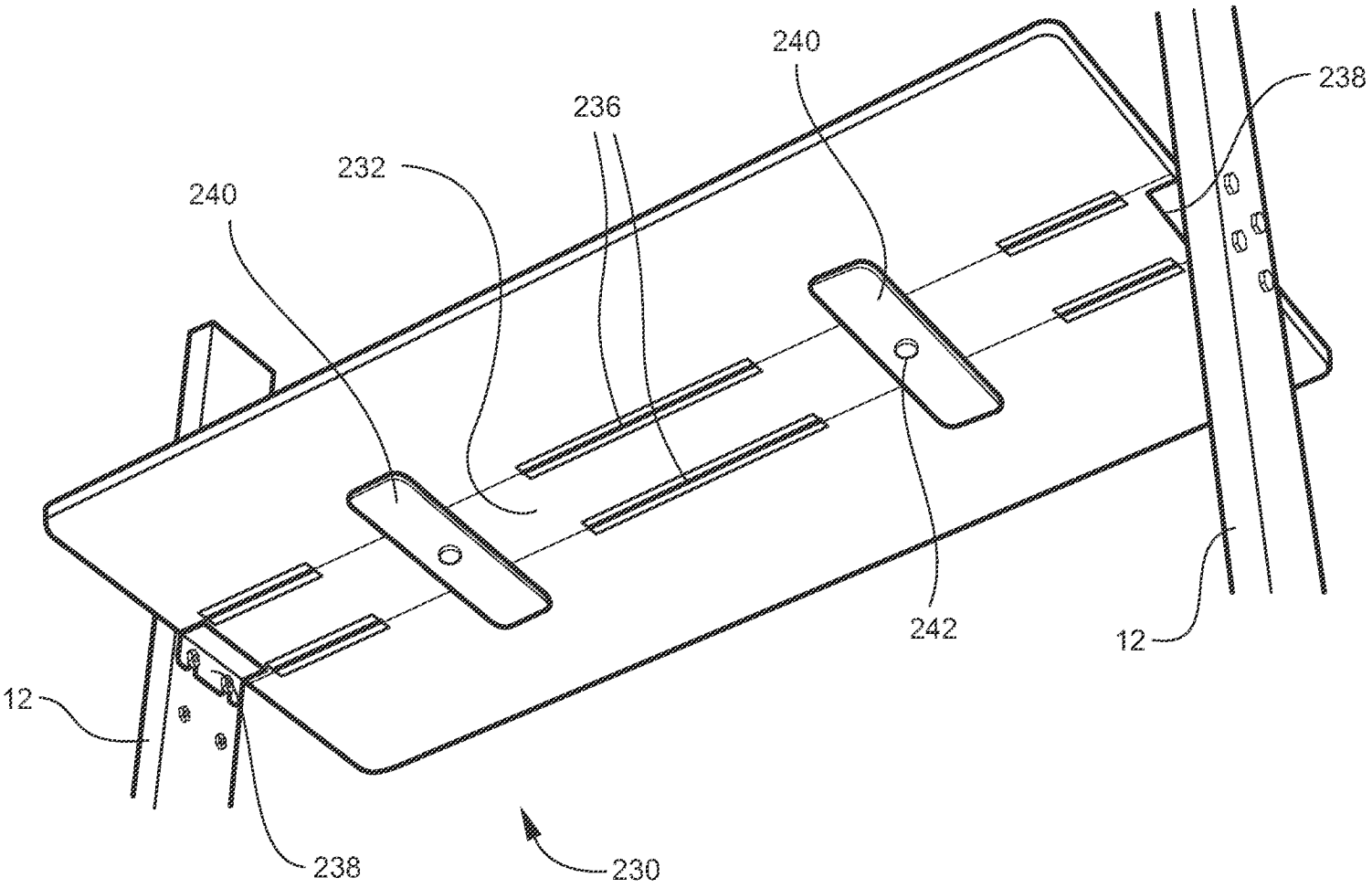
FIG. 31 is an exemplary canopy assembly with a table affixed to the support members in an extended configuration.

The embodiments shown in the attached figures depict a chair 8 suspended from the canopy apparatus 10 by the transverse support members 14, but those of ordinary skill in the art will appreciate that the canopy apparatus can be utilized in conjunction with other types of furniture in other configurations. For instance, the exemplary embodiment depicted in FIGS. 29-31 utilizes a foldable table 230 configuration. The table 130 includes a central leaf 232 hingedly connected to two outer leaves 234 with, for example, piano hinges 236. The central leaf 232 is detachably affixed to the stanchions 12 with, for instance, slotted L-brackets 238 that couple to threated fasters 244 or bosses on the stanchions 12. To increase the area of the working surface for the table 230, the outer leaves 234 can be raised to a horizontal position and held in place by rotating the latch plate 242 about a pin or threaded faster 242, as shown in FIG. 31. The embodiment shown in FIGS. 29-31 is not intended to be limiting, and any shape of table or load bearing 230 surface can be used, such as square, rectangular, elliptical, or circular, and the load-bearing surface 230 can be a unitary surface or made of two or more separate leaves connected together and affixed to the stanchions 12 in any suitable manner, such as welding, soldering, an adhesive, or using fasteners.

The system can comprise a canopy, screen, or fabric made of a flexible, sheet material. The canopy material can comprise, for example and without limitation, a polyvinyl chloride coated aramid fabric, Mylar®, vinyl, nylon, polyester, polypropylene, fiberglass, canvas, or combinations thereof. The canopy can be formed as a continuous, nonporous or woven sheet. The components of the invention can be constructed from any suitable rigid material, including, but not limited to, various metals, plastics, fiberglass, composite materials, wood, or combinations of such materials.

Those of ordinary skill in the art will recognize that the components of the invention can be assembled and secured together using any suitable technique, such as brazing, welding, soldering, adhesives, or fastening with bolts, screws, rivets, anchors, or the like. In yet other embodiments, one or more of the components can be integrally formed.

Although the foregoing description provides embodiments of the invention by way of example, it is envisioned that other embodiments may perform similar functions and/or achieve similar results. Any and all such equivalent embodiments and examples are within the scope of the present invention.

What is claimed is:

1. A deployable canopy apparatus comprising:

(a) a first side canopy rail with a forward segment and a rearward segment and a second side canopy rail with a forward segment and a rearward segment, wherein the first and second side canopy rails have a first axis extending between a forward direction and a rearward direction and a second axis transverse to the first axis;

(b) a spool rod extending between the first side canopy rail and the second side canopy rail along the second axis;

(c) an actuator in mechanical communication with the spool rod and configured to rotate the spool rod;

(d) a first translating member extending at least partially along a distance between the first side canopy rail forward segment and the second side canopy rail forward segment;

(e) a second translating member extending at least partially along a distance between the first side canopy rail rearward segment and the second side canopy rail rearward segment;

(f) a canopy extending between the first side canopy rail and the side second canopy rail, wherein the canopy is secured to the spool rod, and wherein the canopy has a first end secured to the first translating member and a second end secured to the second translating member;

(g) a first spring rod coupled to the canopy and secured within the first side canopy rail forward segment, wherein the first spring rod has a first rod length and a first curvature extending along the first rod length, wherein the first curvature is consistent along the entire first rod length, and wherein the first curvature extends in a direction that is outwardly convex from the canopy from one end of the first spring rod to the other end of the first spring rod;

(h) a second spring rod coupled to the canopy and secured within the first side canopy rail rearward segment, wherein the second spring rod has a second rod length and a second curvature extending along the second rod length, wherein the second curvature is consistent along the entire second rod length, and wherein the second curvature extends in a direction that is outwardly convex from the canopy from one end of the second spring rod to the other end of the second spring rod;

(i) a third spring rod coupled to the canopy and secured within the second side canopy rail forward segment, wherein the third spring rod has a third rod length and a third curvature extending along the third rod length, wherein the third curvature is consistent along the entire third rod length, and wherein the third curvature extends in a direction that is outwardly convex from the canopy from one end of the third spring rod to the other end of the third spring rod;

(j) a fourth spring rod coupled to the canopy and secured within the second side canopy rail rearward segment, wherein the fourth spring rod has a fourth rod length and a fourth curvature extending along the fourth rod length, wherein the fourth curvature is consistent along the entire fourth rod length, and wherein the fourth curvature extends in a direction that is outwardly convex from the canopy from one end of the fourth spring rod to the other end of the fourth spring rod; and (k) a translation drive assembly configured to translate the first translating member in the direction of the first axis along the first and second side canopy rail forward segments and configured to translate the second translating member in the direction of the first axis along the first and second side canopy rail rearward segments.

2. The deployable canopy apparatus of claim 1, wherein:

(a) the first side canopy rail forward segment comprises a channel and a slit extending at least partially along a length of the first side canopy rail forward segment;

(b) the second side canopy rail forward segment comprises a channel and a slit extending at least partially along a length of the first side canopy rail forward segment;

(c) the first side canopy rail rearward segment comprises a channel and a slit extending at least partially along a length of the first side canopy rail rearward segment;

(d) the second side canopy rail rearward segment comprises a channel and a slit extending at least partially along a length of the first side canopy rail rearward segment;

(e) the canopy further comprises:

(i) a first side defining a forward loop housed within the first side canopy rail forward segment and defining a rearward loop housed within the first side canopy rail rearward segment; and (ii) a second side defining a forward loop housed within the second side canopy rail forward segment and defining a rearward loop housed within the second side canopy rail rearward segment;

(f) the first side canopy rail includes (i) the first spring rod secured within the channel of the forward segment, and (ii) the second spring rod secured within the channel of the rearward segment; and (g) the second side canopy rail includes (i) the third spring rod secured within the channel of the forward segment, and (ii) the fourth spring rod secured within the channel of the rearward segment.

3. The deployable canopy apparatus of claim 2, wherein the translation drive assembly comprises:

(a) a first slider with a first groove configured to accommodate the first side canopy rail forward segment slit, wherein the first slider is coupled to the first translating member;

(b) a second slider with a second groove configured to accommodate the second side canopy rail slit forward segment slit, wherein the second slider is coupled to the first translating member;

(c) a third slider with a third groove configured to accommodate the first side canopy rail rearward segment slit, wherein the third slider is coupled to the second translating member;

(d) a fourth slider with a fourth groove configured to accommodate the second side canopy rail rearward segment slit, wherein the fourth slider is coupled to the second translating member;

(e) a first spindle disposed about a first spindle post, wherein the first spindle post is secured to the first side canopy rail forward segment;

(f) a second spindle disposed about a second spindle post, wherein the second spindle post is secured to the second side canopy rail forward segment;

(g) a third spindle disposed about a third spindle post, wherein the third spindle post is secured to the first side canopy rail rearward segment;

(h) a fourth spindle disposed about a fourth spindle post, wherein the fourth spindle post is secured to the second side canopy rail rearward segment;

(i) a first cable spool in mechanical communication with the spool rod such that the first cable spool rotates with the spool rod;

(j) a second cable spool in mechanical communication with the spool rod such that the second cable spool rotates with the spool rod;

(k) a first cable affixed to the first slider, wherein the first cable extends around the first spindle, through a passage in the first cable spool, around the third spindle, and is affixed to the third slider;

(l) a second cable affixed to the second slider, wherein the second cable extends around the second spindle, through a passage in the second cable spool, around the fourth spindle, and is affixed to the fourth slider.

4. The deployable canopy apparatus of claim 3, wherein the first spring rod extends through a first bore in the first slider, the second spring rod extends through a second bore in the second slider, the third spring rod extends through a third bore in the third slider, and the fourth spring rod extends through a fourth bore in the fourth slider.

5. The deployable canopy apparatus of claim 1, wherein the canopy further comprises: (a) a forward canopy segment with a spool end secured to the spool rod; and (b) a rearward canopy segment with a spool end secured to the spool rod.

6. The deployable canopy apparatus of claim 1, wherein the first side canopy rail forward and rearward segments are affixed to a first support by hinges and the second side canopy rail forward and rearward segments are affixed to a second support by hinges.

7. The deployable canopy apparatus of claim 6, wherein one or more of the hinges are square hinges.

8. The deployable canopy apparatus of claim 1, wherein actuator comprises a handle in mechanical communication with the spool rod.

9. The retractable canopy apparatus of claim 1 wherein the actuator comprises:

(a) a first sprocket disposed about the spool rod;

(b) a second sprocket disposed about a crank axil;

(c) a chain placing the first sprocket in mechanical communication with the second sprocket; and (d) a handle in mechanical communication with the crank axil and configured to rotate the crank axil.

10. The deployable canopy apparatus of claim 1 further comprising a canopy tilt assembly.

11. The deployable canopy apparatus of claim 10, wherein the canopy tilt assembly comprises a tilting portion, a tilt lock, and a tilt stop.

12. The deployable canopy apparatus of claim 1, wherein:

(a) at least one transverse support member extends along the second axis between the first side canopy rail and the second side canopy rail;

(b) the first side canopy rail forward and rearward segments are affixed to a first support and extend along the first axis; and (c) the second side canopy rail forward and rearward segments are affixed to a second support and extend along the first axis.

13. The deployable canopy apparatus of claim 12 further comprising a swing pivot assembly affixed to the first support.

14. The deployable canopy apparatus of claim 13, wherein the swing pivot assembly comprises a pin, an elbow housing, and at least one bearing, wherein the at least one bearing and the elbow housing are assembled about the pin.

15. The deployable canopy apparatus of claim 12 further comprising a load-bearing surface affixed to the first support and affixed to the second support along the second axis.

16. The deployable canopy apparatus of claim 15, wherein the load-bearing surface comprises a first leaf hingedly connected to a second leaf.

17. The deployable canopy apparatus of claim 1, wherein the first side canopy rail and the second side canopy rail are curved.

18. A deployable canopy apparatus comprising:

(a) a first support and a second support, the first and second supports having a first axis extending between a forward direction and a rearward direction and a second axis transverse to the first axis;

(b) a spool rod affixed to the first support and affixed to the second support along the second axis;

(c) an actuator in mechanical communication with the spool rod and configured to rotate the spool rod;

(d) a first canopy rail having a free end and a fixed end attached to the first support along the first axis in the forward direction, wherein the first canopy rail includes a channel and a slit extending at least partially along a length of the first canopy rail from the fixed end to the free end;

(e) a second canopy rail having a free end and a fixed end attached to the second support along the first axis in the forward direction, wherein the second canopy rail includes a channel and a slit extending at least partially along a length of the second canopy rail from the fixed end to the free end;

(f) a third canopy rail having a free end and a fixed end attached to the first support along the first axis in the rearward direction, wherein the third canopy rail includes a channel and a slit extending at least partially along a length of the third canopy rail from the fixed end to the free end;

(g) a fourth canopy rail having a free end and a fixed end attached to the second support along the first axis in the rearward direction, wherein the fourth canopy rail includes a channel and a slit extending at least partially along a length of the fourth canopy rail from the fixed end to the free end;

(h) a first translating member extending at least partially along a distance between the first canopy rail and the second canopy rail;

(i) a second translating member extending at least partially along a distance between the third canopy rail and the fourth canopy rail;

(j) a forward canopy having a spool end secured to the spool rod, a translating end secured to the first translating member, a first side defining a loop housed within the first canopy rail channel through the slit, and a second side defining a loop housed within the second canopy rail channel through the slit;

(k) a rearward canopy having a spool end secured to the spool rod, a translating end secured to the second translating member, a first side defining a loop housed within the third canopy rail channel through the slit, and a second side defining a loop housed within the fourth canopy rail channel through the slit;

(l) a first slider with a first bore and a first groove configured to accommodate the first canopy rail slit, wherein the first slider is coupled to the first translating member;

(m) a second slider with a second bore and a second groove configured to accommodate the second canopy rail slit, wherein the second slider is coupled to the first translating member;

(n) a third slider with a third bore and a third groove configured to accommodate the third canopy rail slit, wherein the third slider is coupled to the second translating member;

(o) a fourth slider with a fourth bore and a fourth groove configured to accommodate the fourth canopy rail slit, wherein the fourth slider is coupled to the second translating member;

(p) a first spring rod extending through the forward canopy first side loop and the first bore and secured within the first canopy rail channel;

(q) a second spring rod extending through the forward canopy second side loop and the second bore and secured within the second canopy rail channel;

(r) a third spring rod extending through the rearward canopy first side loop and the third bore and secured within the third canopy rail channel;

(s) a fourth spring rod extending through the rearward canopy second side loop and the fourth bore and secured within the fourth canopy rail channel;

(t) a first spindle disposed about a first spindle post, wherein the first spindle post is secured to the first canopy rail;

(u) a second spindle disposed about a second spindle post, wherein the second spindle post is secured to the second canopy rail;

(v) a third spindle disposed about a third spindle post, wherein the third spindle post is secured to the third canopy rail;

(w) a fourth spindle disposed about a fourth spindle post, wherein the fourth spindle post is secured to the fourth canopy rail;

(x) a first cable spool in mechanical communication with the spool rod such that the first cable spool rotates with the spool rod and a second cable spool in mechanical communication with the spool rod such that the second cable spool rotates with the spool rod;

(y) a first cable affixed to the first slider, wherein the first cable extends around the first spindle, through a passage in the first cable spool, around the third spindle, and is affixed to the third slider; and (z) a second cable affixed to the second slider, wherein the second cable extends around the second spindle, through a passage in the second cable spool, around the fourth spindle, and is affixed to the fourth slider.

19. The deployable canopy apparatus of claim 18 wherein the actuator comprises:

(a) a first sprocket disposed about the spool rod;

(b) a second sprocket disposed about a crank axil;

(c) a chain placing the first sprocket in mechanical communication with the second sprocket; and (d) a handle in mechanical communication with the crank axil and configured to rotate the crank axil.

20. A deployable canopy apparatus comprising:

(a) a first canopy rail having a free end and a spool end and a first axis extending along a direction from the free end to the spool end, wherein the first canopy rail includes a channel and a slit extending at least partially along a length of the first canopy rail from the spool end to the free end;

(b) a second canopy rail having a free end and a spool end and a first axis extending along a direction from the free end to the spool end, wherein the second canopy rail includes a channel and a slit extending at least partially along a length of the second canopy rail from the spool end to the free end;

(c) a spool rod extending between the first canopy rail and the second canopy rail along a second axis transverse to the first canopy rail first axis and the second canopy rail first axis;

(d) an actuator in mechanical communication with the spool rod and configured to rotate the spool rod;

(e) a translating member extending at least partially along a distance between the first canopy rail and the second canopy rail;

(f) a canopy having a spool end secured to the spool rod, a translating end secured to the translating member, a first side defining a loop housed within the first canopy rail channel, and a second side defining a loop housed within the second canopy rail channel;

(g) a first spring rod extending through the canopy first side loop and secured within the first canopy rail channel, wherein the first spring rod has a first rod length and a first curvature extending along the first rod length, wherein the first curvature is consistent along the entire first rod length, and wherein the first curvature extends in a direction that is outwardly convex from the canopy from one end of the first spring rod to the other end of the first spring rod;

(h) a second spring rod extending through the canopy second side loop and secured within the second canopy rail channel, wherein the second spring rod has a second rod length and a second curvature extending along the second rod length, wherein the second curvature is consistent along the entire second rod length, and wherein the second curvature extends in a direction that is outwardly convex from the canopy from one end of the second spring rod to the other end of the second spring rod;

(i) a translation drive assembly configured to translate the translating member between the free ends and the fixed ends of the first and second canopy rails.

21. The deployable canopy apparatus of claim 20, wherein the translation drive assembly comprises:

(a) a first slider with a first groove configured to accommodate the first canopy rail slit and a first bore, wherein the first slider is coupled to the first translating member, and wherein the first spring rod extends through the first bore;

(b) a second slider with a second groove configured to accommodate the second canopy rail slit and a second bore, wherein the second slider is coupled to the first translating member, and wherein the second spring rod extends through the second bore;

(c) a first spindle disposed about a first spindle post, wherein the first spindle post is secured to the first canopy rail;

(d) a second spindle disposed about a second spindle post, wherein the second spindle post is secured to the second canopy rail;

(e) a first cable spool in mechanical communication with the spool rod such that the first cable spool rotates with the spool rod;

(f) a second cable spool in mechanical communication with the spool rod such that the second cable spool rotates with the spool rod;

(g) a first cable with a slider end and a spool end, wherein the slider end is affixed to the first slider, the first cable extends around the first spindle, and the first cable spool end is secured to the cable spool;

(h) a second cable with a slider end and a spool end, wherein the slider end is affixed to the second slider, the second cable extends around the second spindle, and the second cable spool end is secured to the cable spool.

* * * * *